US008700238B2

(12) United States Patent
Hiramatsu

(10) Patent No.: US 8,700,238 B2
(45) Date of Patent: Apr. 15, 2014

(54) MARINE VESSEL PROPULSION CONTROL APPARATUS AND MARINE VESSEL

(75) Inventor: Yuji Hiramatsu, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 575 days.

(21) Appl. No.: 12/860,949

(22) Filed: Aug. 23, 2010

(65) Prior Publication Data

US 2011/0166724 A1 Jul. 7, 2011

(30) Foreign Application Priority Data

Jan. 7, 2010 (JP) ..... 2010-002177

(51) Int. Cl.

| | |
|---|---|
| ***B60L 15/00*** | (2006.01) |
| ***B63H 11/107*** | (2006.01) |
| ***B63H 20/08*** | (2006.01) |
| ***B63H 25/10*** | (2006.01) |

(52) U.S. Cl.
USPC ..... 701/21; 440/40; 440/53; 114/144 R

(58) Field of Classification Search
USPC ..... 701/21; 702/85; 440/40, 41, 53, 63, 84; 114/144 R, 102.1, 55.5
See application file for complete search history.

(56) References Cited

U.S. PATENT DOCUMENTS

| | | | | |
|---|---|---|---|---|
| 7,467,595 | B1 * | 12/2008 | Lanyi et al. | 114/144 R |
| 2005/0092225 | A1 * | 5/2005 | Kaji et al. | 114/144 R |
| 2009/0084299 | A1 | 4/2009 | Mizutani | |
| 2010/0023192 | A1 | 1/2010 | Rae et al. | |
| 2010/0116190 | A1 * | 5/2010 | Ito | 114/144 RE |

FOREIGN PATENT DOCUMENTS

| | | | |
|---|---|---|---|
| JP | 2005-145439 | A | 6/2005 |
| JP | 2005-200004 | A | 7/2005 |
| JP | 2008-155764 | A | 7/2008 |
| JP | 2009-083596 | A | 4/2009 |
| JP | 2009-538782 | A | 11/2009 |

OTHER PUBLICATIONS

Official Communication issued in corresponding European Patent Application No. 10186462.7, mailed on May 19, 2011.

* cited by examiner

*Primary Examiner* — Muhammad Shafi
(74) *Attorney, Agent, or Firm* — Keating & Bennett, LLP

(57) ABSTRACT

A marine vessel propulsion control apparatus is arranged to control a propulsion unit and a steering unit. The marine vessel propulsion control apparatus includes a joystick unit, and a control unit programmed to control an output of the propulsion unit and a steering angle of the steering unit in accordance with an output signal of the joystick unit. The joystick unit includes a lever that is tiltable from a neutral position and arranged to be operated by a marine vessel operator to command a heading direction and stem turning of a hull. The control unit is programmed to maintain the steering angle of the steering unit when the output of the propulsion unit is stopped.

10 Claims, 21 Drawing Sheets

FIG. 6A (COMPARATIVE EXAMPLE)
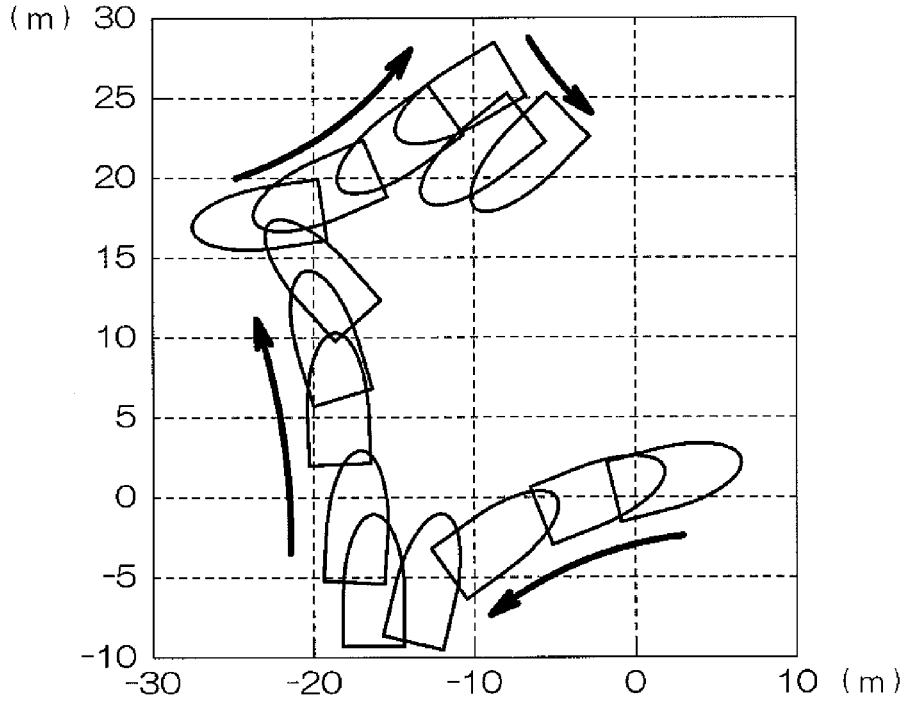
FIG. 6B (COMPARATIVE EXAMPLE)
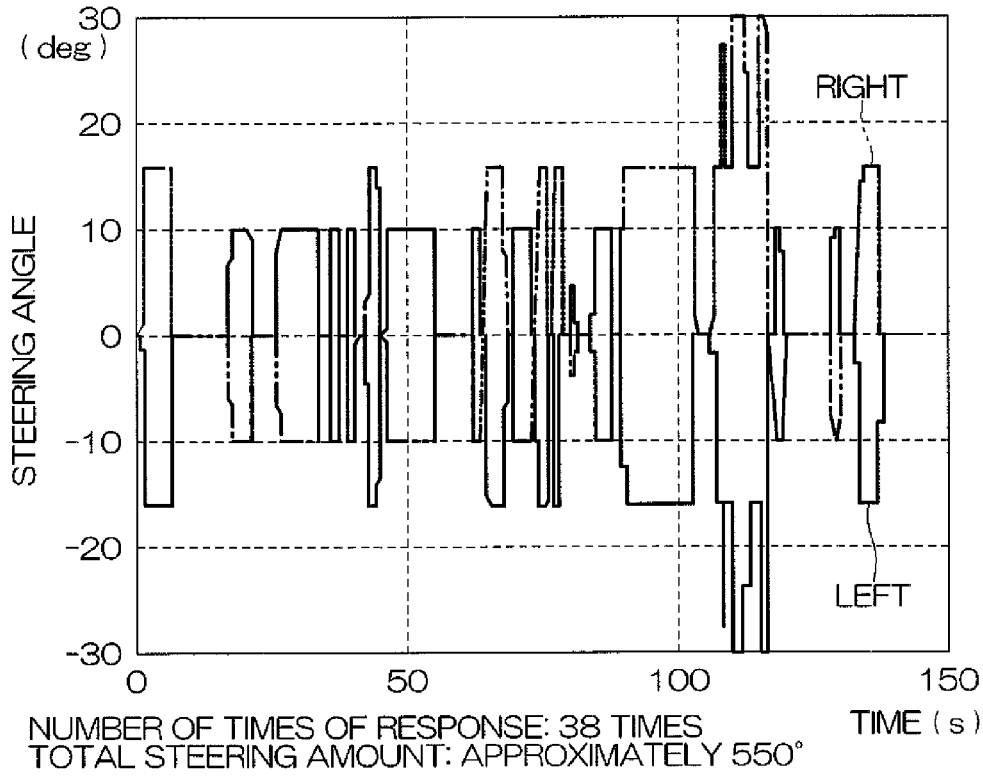

NUMBER OF TIMES OF RESPONSE: 5 TIMES (REDUCED TO 13.2(%))
TOTAL STEERING AMOUNT: APPROXIMATELY 200°
(REDUCED TO 36.4(%))

MARINE VESSEL PROPULSION CONTROL APPARATUS AND MARINE VESSEL

BACKGROUND OF THE INVENTION

1. Field of the Invention

The present invention relates to a marine vessel propulsion control apparatus to control a propulsion unit and a steering unit, and to a marine vessel that includes such a marine vessel propulsion control apparatus.

2. Description of Related Art

A control apparatus to control a propulsion unit and a steering unit in accordance with an operation of a joystick is disclosed in Japanese Unexamined Patent Publication No. 2008-155764. The joystick includes a lever that is tiltable from a neutral position. A direction of a propulsive force is controlled in accordance with an operation direction of the lever, and a magnitude of the propulsive force is controlled in accordance with a tilt amount of the joystick. The joystick includes, for example, a spring that applies a restorative force, directed toward the neutral position, to the lever. When a marine vessel operator weakens an operation force applied to the lever, the lever is returned to the neutral position by the restorative force of the spring.

SUMMARY OF THE INVENTION

The inventor of preferred embodiments of the present invention described and claimed in the present application conducted an extensive study and research regarding marine vessel propulsion control apparatuses, such as the one described above, and in doing so, discovered and first recognized new unique challenges and previously unrecognized possibilities for improvements as described in greater detail below.

During leaving and docking, etc., the marine vessel operator performs an operation of frequently changing a heading direction and an attitude of the marine vessel. The same type of operation is required to maintain a heading of the marine vessel or to maintain a position of the marine vessel against wind or current flow.

In such a case, the propulsive force of the propulsion unit and a steering angle of the steering unit are changed frequently by operation of the joystick. Especially during marine vessel maneuvering by the joystick, an operation of tilting the lever for just a short time and then returning the lever to the neutral position is performed repeatedly. In response to such a repeated operation, the steering angle of the steering unit changes frequently. More specifically, when the attitude of the marine vessel is to be adjusted finely, the marine vessel operator repeatedly executes the operation of tilting the lever in one direction for just a short time. Accordingly, the steering angle changes frequently between a value corresponding to the operation direction and a neutral value (for example, zero).

For example, an outboard motor, which is an example of a propulsion unit, can preferably function as a steering member that pivots right and left with respect to a hull. In this case, the steering unit pivots the outboard motor to the right and left. The outboard motor is thus frequently pivoted between a position steered to the right or the left and a neutral position.

Such frequent steering operations may lower energy efficiency.

In order to overcome the previously unrecognized and unsolved challenges described above, a preferred embodiment of the present invention provides a marine vessel propulsion control apparatus that is arranged to control a propulsion unit and a steering unit. The marine vessel propulsion control apparatus includes a joystick unit which in turn includes a lever that is tiltable from a neutral position and arranged to be operated by a marine vessel operator to command a heading direction and stem turning of a marine vessel, and a control unit arranged and programmed to control an output of the propulsion unit and a steering angle of the steering unit in accordance with an output signal of the joystick unit. The control unit is arranged and programmed to maintain the steering angle of the steering unit when the output of the propulsion unit is stopped.

When the output of the propulsion unit is stopped, a change of the steering angle does not contribute to a change of attitude of the hull. Thus, when the output of the propulsion unit is stopped, the control unit does not change the steering angle of the steering unit but maintains it at a previous value. Thus, even when lever operation of the joystick unit is repeated frequently, meaningless changes of the steering angle can be prevented and minimized. Consequently, energy consumption of the steering unit can be reduced and minimized to contribute to energy efficiency.

In a preferred embodiment of the present invention, the marine vessel propulsion control apparatus is arranged to control a right propulsion unit and a left propulsion unit, respectively disposed at a right and left of the marine vessel, and a right steering unit and a left steering unit, respectively corresponding to the right propulsion unit and the left propulsion unit. In this case, the control unit may be arranged to control the steering angles of the right and left steering units so that lines of action of the propulsive forces generated by the right and left propulsion units define a V shape or an inverted V shape. Preferably, the control unit is arranged and programmed to maintain the state where the lines of action define the V shape or inverted V shape by maintaining the steering angles of the right and left steering units when the outputs of the right and left propulsion units are stopped.

A "line of action" is a rectilinear line passing through an action point of a propulsive force and extending along a direction of the propulsive force in plan view. A "V shape" or an "inverted V shape" (in other words, a Λ shape) is a shape defined by lines of action in plan view. More specifically, a pair of lines of action define a V shape when an intersection thereof is positioned to the rear relative to the propulsion units. That is, the V shape is defined by the propulsive force action points of the right and left propulsion units and the intersection. Also, a pair of lines of action define an inverted V shape when the intersection thereof is positioned in front relative to the propulsion units. That is, the inverted V shape is defined by the propulsive force action points of the right and left propulsion units and the intersection.

For example, when the pair of lines of action define an inverted V shape, the steering angles can be controlled to be in a state where both lines pass through a center of rotation of the hull. In this case, the propulsive forces generated by the right and left propulsion units do not apply substantial stem turning moments to the hull. Parallel movement, in which the position of the hull is changed without changing the heading of the hull, can thus be performed. More specifically, the marine vessel can be made to undergo parallel movement in a right direction or a left direction by tilting the lever of the joystick unit to the right or left. Obliquely right or left forward or obliquely right or left reverse parallel movement can also be performed by adjusting the propulsive forces generated by the right and left propulsion units.

During leaving and docking, etc., the marine vessel operator may repeatedly perform an operation of tilting the lever from the neutral position for just a short time to make the marine vessel undergo parallel movement a little at a time. In this case, when the lever is returned to the neutral position and the outputs from the propulsion units are thus stopped, the steering angles of the right and left propulsion units are maintained as they are and the state where, for example, the lines of action define the inverted V shape, is maintained. That is, the steering angles do not change frequently between the neutral value and the values at which the lines of action define the inverted V shape. The neutral value is, for example, the steering angle value when the propulsive force acts in a front or rear direction of the hull, that is, in a direction parallel to a hull center line.

When the pair of lines of action define a V shape, the propulsive forces generated by the right and left propulsion units both apply stem turning moments to the hull. If the stem turning moments that the right and left propulsion units apply to the hull act in opposite directions, the moments cancel each other out at least partially. The hull can thus be driven forward or in reverse or be turned to the right or left. If the stem turning moments that the right and left propulsion units apply to the hull act in the same direction, for example, stem turning of the hull can be performed without substantially changing the position of the hull.

During leaving and docking, etc., the marine vessel operator may repeatedly perform a joystick operation to provide a stem turning command for just a short time to perform stem turning of the marine vessel a little at a time. In this case, when the stem turning command is interrupted and the outputs from the propulsion units are thus stopped, the steering angles of the right and left propulsion units are maintained as they are and the state where, for example, the lines of action define the V shape, is maintained. That is, the steering angles do not change frequently between the neutral value and the values at which the lines of action define the V shape.

Meaningless changes of the steering angles are thus prevented and minimized to enable a contribution to be made to energy efficiency of the steering units.

In a preferred embodiment of the present invention, the marine vessel propulsion control apparatus is arranged to control a right propulsion unit and a left propulsion unit, respectively disposed at the right and left of the hull, and a right steering unit and a left steering unit, respectively corresponding to the right propulsion unit and the left propulsion unit. The lever is arranged to be tiltable to the front, rear, right, and left from the neutral position. Also, the control unit is arranged and programmed to control the steering angles of the right and left steering units so that lines of action of the propulsive forces generated by the right and left propulsion units define a V shape or an inverted V shape. Preferably in this case, the control unit is arranged and programmed to maintain the state where the lines of action of the right and left propulsion units define the V shape or inverted V shape by maintaining the steering angles of the right and left steering units when a right/left direction tilt amount of the lever becomes no more than a predetermined value (for example, zero or within a predetermined dead zone).

With this arrangement, the steering angles of the right and left steering units are maintained when the lever is returned to the neutral position or a vicinity thereof and the propulsion units should thus no longer generate propulsive forces. The lines of action of the right and left propulsion units are thereby maintained in states of defining a V shape or an inverted V shape. Meaningless steering angles changes are thus lessened to enable a contribution to be made to energy efficiency of the steering units.

In a preferred embodiment of the present invention, the joystick unit preferably further includes a pivoting operation section arranged to be pivotable from a neutral position. Preferably in this case, the control unit is arranged and programmed to control the output of the propulsion unit and the steering angle of the steering unit to apply a stem turning moment to the hull in accordance with operation of the pivoting operation section.

The pivoting operation section may be arranged to be pivotable about an axis of the lever. More specifically, the pivoting operation section may include a knob provided at a tip of the lever. The knob may pivot together with the lever or may pivot relative to the lever. The pivoting operation unit may be provided separately of the lever.

For example, there may be a case where the pivoting operation section is returned to the neutral position so that the generation of propulsive force by the propulsion unit is no longer necessary. In such a case, the steering angle of the steering unit is maintained. For example, there may be a case where right and left propulsion units are provided as mentioned above and, to make the hull undergo stem turning, the steering angles are controlled so that the lines of actions of the propulsive forces define an inverted V shape. In this case, when the pivoting operation section is returned to the neutral position, the steering angles of the right and left steering units can be maintained to maintain the state where the pair of lines of action define the inverted V shape.

The control unit may be arranged and programmed to control the output of the propulsion unit in accordance with front/rear direction tilting of the lever and control the steering angle of the steering unit in accordance with operation of the pivoting operation section. Preferably in this case, the control unit is arranged and programmed to stop the output of the propulsion unit and maintain the steering angle of the steering unit when the lever and the pivoting operation section are returned to the respective neutral positions.

In this arrangement, the propulsive force is adjusted according to the front/rear direction tilting of the lever and the steering angle is controlled according to the pivoting of the pivoting operation section. The output of the propulsion unit is thus stopped when the lever and the pivoting operation section are at the respective neutral positions. In this state, the steering angle of the steering unit is maintained. That is, the steering angle is maintained in the state of having been adjusted by the operation of the pivoting operation section. A certain response time is necessary for the steering angle to actually change from the point at which the pivoting operation section, etc., is operated. When the lever and the pivoting operation section are returned to the respective neutral positions within the response time, the steering angle change is invalidated.

The control unit may be arranged and programmed to control the steering angle of the steering unit to be within a steering angle range among a neutral range that includes a neutral value, a first range at one side of the neutral range, and a second range at the other side of the neutral range. Preferably in this case, the control unit is further arranged and programmed to control the steering angle of the steering unit in accordance with the operation of the pivoting operation section without changing the steering angle range when the pivoting operation section is pivoted from its neutral position in the state where the lever is at its neutral position. By this arrangement, changes of steering angle when the lever is at the neutral position are suppressed, and steering angle changes are thus lessened further. A further contribution to energy efficiency can thus be made.

As mentioned above, the neutral value is the steering angle value at which the line of action of the propulsive force extends along the front/rear direction of the hull (in a direction parallel or substantially parallel to the hull center line). The neutral range may be a range that includes only the neutral value or may be a range of a fixed angle to the right and left that includes the neutral value.

The propulsion unit may be arranged to be capable of switching the direction of the propulsive force between a first direction and a second direction that are directly opposite each other. More specifically, the propulsion unit may be capable of switching the propulsive force between a forward drive direction and a reverse drive direction. Preferably in this case, the control unit is arranged and programmed to control the direction of the propulsive force of the propulsion unit to the first direction or the second direction in accordance with the operation of the pivoting operation section if, when the pivoting operation section is operated with the lever being at the neutral position, the steering angle of the steering unit is not within the neutral range that includes the neutral value.

When the steering angle is not in the neutral range, a stem turning moment in one direction can be applied to the hull by making the propulsion unit generate the propulsive force in the first direction. Also, a stem turning moment in the other direction can be applied to the hull by making the propulsion unit generate the propulsive force in the second direction. A stem turning moment in either direction can thereby be applied to the hull while keeping the steering angle change at a minimum. A contribution can thereby be made to energy efficiency of the steering unit.

A marine vessel propulsion control apparatus according to a preferred embodiment of the present invention further includes a mode switching unit that is arranged to switch a control mode of the control unit between an ordinary maneuvering mode and a joystick maneuvering mode. Preferably in this case, the control unit is arranged and programmed to control the output of the propulsion unit in accordance with operation of a remote control lever provided in the marine vessel and control the steering angle of the steering unit in accordance with operation of a steering operation member provided in the marine vessel in the ordinary maneuvering mode. Also, preferably, the control unit is arranged and programmed to control the output of the propulsion unit and the steering angle of the steering unit in accordance with operation of the joystick unit and maintain the steering angle of the steering unit when the output of the propulsion unit is stopped in the joystick maneuvering mode.

In the ordinary maneuvering mode, the output of the propulsion unit and the steering angle of the steering unit can be adjusted by operations of the steering operation member and the remote control lever. For example, in a case where a pair of right and left propulsion units and a corresponding pair of right and left steering units are provided, the steering angles of the pair of right and left steering units may be controlled to have values that are practically equal to each other in the ordinary maneuvering mode. That is, the lines of action of the propulsive forces of the pair of right and left propulsion units may be put in a state of being substantially parallel to each other. Thus, by operation of the steering operation member, the steering angles of the right and left steering units are changed synchronously while the pair of lines of action are maintained in the state of being substantially parallel to each other. The ordinary maneuvering mode is thus suited for marine vessel maneuvering in an open sea, etc. Adjustment of the propulsive force is performed by operation of the remote control lever that is provided separately from the steering operation member.

In the joystick maneuvering mode, the behavior of the marine vessel can be controlled at high precision by operation of the joystick unit. For example, the marine vessel may be provided with a pair of right and left propulsion units and a corresponding pair of right and left steering units. In this case, in the joystick maneuvering mode, the steering angles of the pair of right and left steering units may be controlled so that the lines of action of the propulsive forces of the right and left propulsion units define a V shape or an inverted V shape.

In a preferred embodiment of the present invention, the marine vessel propulsion control apparatus further includes a heading maintenance commanding unit that is arranged to be operated by the marine vessel operator to maintain the heading of the hull, and a heading detecting unit that is arranged to detect the heading of the hull. Preferably, in this case, the control unit is arranged and programmed to control the output of the propulsion unit and the steering angle of the steering unit based on an output of the heading detecting unit to maintain the heading of the hull when the heading maintenance commanding unit is operated. The heading of the hull is thereby maintained automatically when the heading maintenance commanding unit is operated. Marine vessel maneuvering during drift fishing, which is performed by letting the hull move while directing it in a fixed heading, and during trolling in which the hull is made to travel at a fixed speed while being directed in a fixed heading, is thereby facilitated.

The propulsion unit may be arranged to be capable of switching the direction of the propulsive force between a first direction and a second direction that are directly opposite each other. Preferably, in this case, the control unit is arranged and programmed to maintain the heading of the hull by controlling the direction and magnitude of the propulsive force of the propulsion unit without changing the steering angle when the steering angle of the steering unit is not within the neutral range that includes the neutral value. The heading of the hull is thereby maintained by applying an appropriate stem turning moment in one direction or the other direction to the hull without changing the steering angle. Consequently, the heading of the hull can be maintained fixed with little change of the steering angle, and a contribution can thus be made to energy efficiency.

A marine vessel propulsion control apparatus according to a preferred embodiment of the present invention further includes a heading detecting unit that is arranged to detect the heading of the hull. Preferably, in this case, the control unit is arranged and programmed to control the output of the propulsion unit and the steering angle of the steering unit based on an output of the heading detecting unit so that when a predetermined command input is provided (for example, when a command for reverse drive along the front/rear direction of the hull is input), the heading of the hull at the time of the input is maintained. By this arrangement, the control for maintaining the heading of the hull is executed in response to the predetermined command input. For example, in a case where the propulsion unit is arranged to generate the propulsive force by rotation of a propeller, a control that compensates for a lateral force due to the rotation of the propeller (a lateral force due to a so-called gyro effect) can be executed. More specifically, the control of maintaining the heading of the hull may be executed in response to a command input for driving the hull in reverse rectilinearly. The lateral force due to the gyro effect, etc., is thereby compensated to realize a reverse drive that is in accordance with an intention of the marine vessel operator.

A marine vessel propulsion control apparatus according to a preferred embodiment of the present invention further includes a fixed point maintenance commanding unit that is arranged to be operated by the marine vessel operator to maintain the position and the heading of the hull, a position detecting unit that is arranged to detect the position of the hull, and a heading detecting unit that is arranged to detect the heading of the hull. Preferably, in this case, the control unit is arranged and programmed to control the output of the propulsion unit and the steering angle of the steering unit based on outputs of the position detecting unit and the heading detecting unit to maintain the position and the heading of the hull when the fixed point maintenance commanding unit is operated.

With this arrangement, by operation of the fixed point maintenance commanding unit, the propulsive force and the steering angle are controlled so as to maintain the hull position and the hull heading. The hull can thereby be maintained at a fixed point without requiring a complex operation. Fixed point maintenance of the hull can be used to maintain the hull at a fishing point and can also be used to perform kite fishing. Kite fishing is a fishing method with which a kite is flown from a marine vessel and a fishing line is dropped underwater from a kite line. In ordinary kite fishing, a parachute, called a sea anchor, is deployed underwater to prevent movement of the hull. By executing the above-described fixed point maintenance control, the marine vessel can be maintained at a fixed point to enable kite fishing to be performed without using the sea anchor.

A marine vessel propulsion control apparatus according to a preferred embodiment of the present invention further includes a calibration operation unit arranged to be operated by an operator to set a propulsive force (and further a steering angle where necessary) corresponding to a predetermined hull behavior. Preferably, in this case, the control unit is arranged and programmed to renew a relationship characteristic of the joystick unit output signal and the propulsive force (and further the steering angle where necessary) in response to the operation of the calibration operation unit so that the predetermined hull behavior and the propulsive force (and further the steering angle where necessary) correspond.

For example, the control unit may be arranged and programmed to renew the relationship characteristic based on an average value of the propulsive force (and further the steering angle where necessary) from the point of operation of the calibration operation unit to a point after an elapse of a predetermined time. Also, the control unit may be arranged and programmed to renew the relationship characteristic based on the propulsive force (and further the steering angle where necessary) at the point of operation of the calibration operation unit. Further, the control unit may be arranged and programmed to renew the relationship characteristic based on the propulsive force (and further the steering angle where necessary) in a period preceding the point of operation of the calibration operation unit by just a predetermined time.

The calibration operation unit may include a lateral movement calibration operation unit that is arranged to be operated by an operator to renew the relationship characteristic with respect to a lateral movement of the hull (an example of the predetermined hull behavior). Also, the calibration operation unit may include a stem turning calibration operation unit that is arranged to be operated by an operator to renew the relationship characteristic with respect to an on-the-spot stem turning of the hull (an example of the predetermined hull behavior).

A joystick operation for commanding the lateral movement of the hull may, for example, be an operation of tilting the lever in the right direction or the left direction. In this case, the relationship characteristic is associated with such a joystick operation. Thus, if the calibration has been executed, the lateral movement of the hull can be performed by performing the operation of tilting the lever in the right direction or the left direction. Before the execution of calibration, the tilting of the lever in the right direction or the left direction may result, for example, in stem turning of the hull or movement of the hull in an oblique direction. By executing the calibration, it becomes possible to easily perform lateral movement of the hull in accordance with the right or left tilting operation of the lever.

The joystick operation for commanding on-the-spot stem turning of the hull may, for example, be an operation of pivoting the pivoting operation section with the lever being maintained at the neutral position. The relationship characteristic is associated with such a joystick operation. Thus, if the calibration has been executed, the hull can be stem turned at a minimum rotation radius by pivoting the pivoting operation section while maintaining the lever at the neutral position. Before the execution of calibration, the same joystick operation may result in stem turning being executed with the hull moving largely or in a large rotation radius. By executing the calibration, stem turning at the minimum rotation radius can be performed reliably by the joystick operation.

A preferred embodiment of the present invention provides a marine vessel that includes a hull, a propulsion unit and a steering unit that are provided in the hull, and a marine vessel propulsion control apparatus arranged and programmed to control the propulsion unit and the steering unit and has the characteristics described above.

The marine vessel is not limited and may be a comparatively small-scale marine vessel such as a cruiser, a fishing boat, a water jet or a watercraft, etc., for example.

The propulsion unit is not limited and may be in the form of any of an outboard motor, an inboard/outboard motor (a stern drive or an inboard motor/outboard drive), an inboard motor, and a water jet drive. The outboard motor includes a propulsion unit provided outboard of the vessel and having a motor (an internal combustion engine or an electric motor) and a propulsive force generating member (propeller). In this case, the steering unit is arranged to horizontally pivot the entire outboard motor with respect to the hull. The inboard/outboard motor includes a motor provided inboard of the vessel, and a drive unit provided outboard and having a propulsive force generating member. In this case, the steering unit is arranged to pivot the drive unit to the right and left with respect to the hull. The inboard motor preferably has a form where a motor and a drive unit are both provided inboard, and a propeller shaft extends outboard from the drive unit. In this case, the steering unit is arranged to pivot a helm unit, disposed separately of the motor and the drive unit, to the right and left with respect to the hull. The water jet drive is arranged to suck water from the bottom of the marine vessel, accelerate the sucked-in water by a jet pump, and eject the water from an ejection nozzle at the stern of the marine vessel to provide a propulsive force. In this case, the steering unit is arranged to pivot a deflector, which changes a water stream ejected from the ejection nozzle, to the right and left.

The above and other elements, features, steps, characteristics and advantages of the present invention will become more apparent from the following detailed description of the preferred embodiments with reference to the attached drawings.

BRIEF DESCRIPTION OF THE DRAWINGS

FIGS. 6A and 6B are diagrams of results of an experiment conducted by the present inventor in the joystick maneuvering mode.

DETAILED DESCRIPTION OF THE PREFERRED EMBODIMENTS

First Preferred Embodiment

Figure 1:
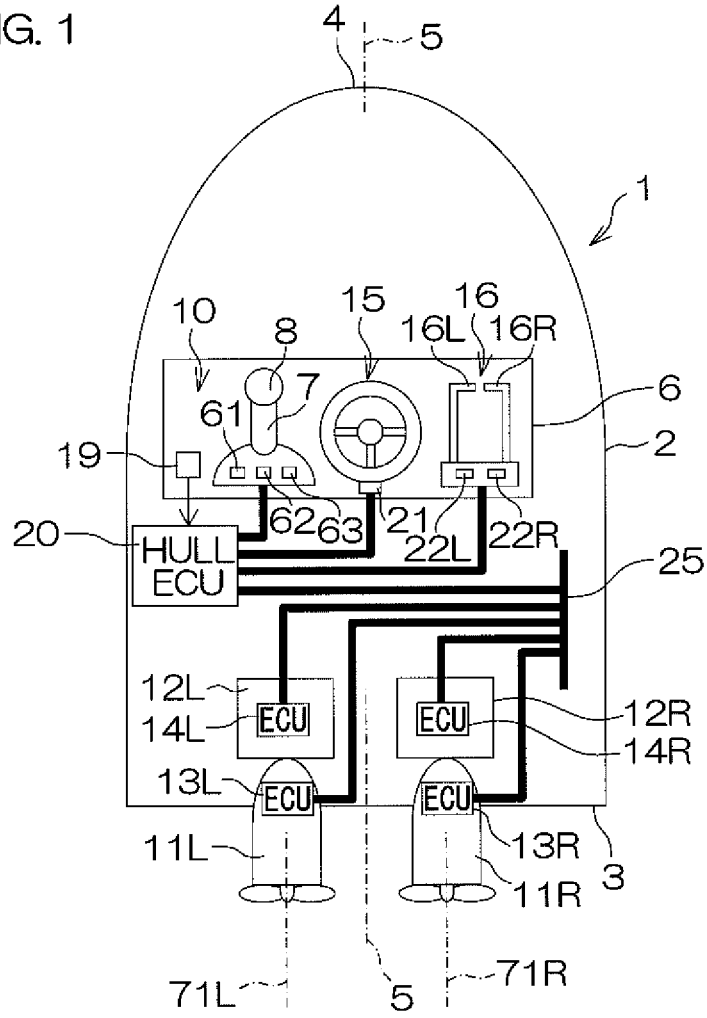
FIG. 1 is a schematic diagram for explaining an arrangement of a marine vessel according to a preferred embodiment of the present invention.

FIG. 1 is a schematic diagram for explaining an arrangement of a marine vessel 1 according to a preferred embodiment of the present invention. The marine vessel 1 preferably is a comparatively small-scale marine vessel, such as a cruiser or a boat, for example. A pair of outboard motors 11R and 11L are attached as propulsion units respectively via a pair of steering units 12R and 12L to a hull 2 of the marine vessel 1.

The outboard motors 11R and 11L are attached to a stern (transom) 3 of the hull 2. The pair of outboard motors 11R and 11L are attached at positions that are right/left symmetrical with respect to a center line 5 passing through the stern 3 and a stem 4 of the hull 2. That is, one outboard motor 11L is attached to a rear port portion of the hull 2, and the other outboard motor 11R is attached to a rear starboard portion of the hull 2. In the following description, these outboard motors shall be referred to as the "right outboard motor 11R" and the "left outboard motor 11L" when these are to be distinguished.

The steering units 12R and 12L are arranged to steer the right outboard motor 11R and the left outboard motor 11L, respectively, to the right and left. In the following description, the steering units shall be referred to as the "right steering unit 12R" and the "left steering unit 12L" when these are to be distinguished. Directions of propulsive forces generated by the outboard motors 11R and 11L are changed by the steering units 12R and 12L steering the outboard motors 11R and 11L to the right and left. A line passing through an action point of the propulsive force and extending along the direction of the propulsive force shall be referred to as a "line of action," and an angle that the "line of action" defines with respect to the hull center line 5 shall be referred to as a "steering angle" of the steering unit 12R or 12L. When the lines of action 71R and 71L are parallel to the hull center line 5, the steering angles take on a value of zero (neutral value). When front sides of the lines of action 71R and 71L are positioned to the left with respect to the state of being parallel to the hull center line 5, the steering angles shall be expressed by positive values, and when the front sides of the lines of action 71R and 71L are positioned to the right with respect to the state of being parallel to the hull center line 5, the steering angles shall be expressed by negative values. The action points at which the propulsive forces generated by the outboard motors 11R and 11L act on the hull 2 are, for example, pivoting centers (steering shafts 35 to be described below; see FIG. 2) of the outboard motors 11R and 11L when the outboard motors 11R and 11L are pivoted to the right or left.

Electronic control units 13R and 13L (hereinafter referred to as "right outboard motor ECU 13R" and "left outboard motor ECU 13L") are incorporated in the right outboard motor 11R and the left outboard motor 11L, respectively. Further, electronic control units 14R and 14L (hereinafter referred to as "right steering ECU 14R" and "left steering ECU 14L") are provided in the right steering unit 12R and the left steering unit 12L, respectively.

An operation console 6 for marine vessel maneuvering is provided at a marine vessel operator compartment of the hull 2. The operation console 6 includes a joystick unit 10, a steering wheel 15 (steering operation member), and a remote control lever unit 16. The joystick unit 10 includes a lever 7. A knob 8 (pivoting operation section), which can be operated so as to pivot about an axis of the lever 7, is provided at a head portion of the lever 7. The lever 7 is arranged to be tiltable freely in any direction to the front, rear, right, and left. A tilt amount in a front/rear direction and a tilt amount in a right/left direction are respectively detected by sensors (potentiometers or other position sensors). A pivoting operation amount of the knob 8 is detected by a separate sensor (potentiometer or other position sensor).

Signals expressing the tilt amounts of the lever 7 and the pivoting operation amount of the knob 8 are input into a hull ECU 20 (control unit).

The hull ECU 20 is an electronic control unit (ECU) that includes a microcomputer. The hull ECU 20 communicates with the ECUs 13R, 13L, 14R, and 14L via a LAN (local area network; hereinafter referred to as the "inboard LAN") disposed inside the hull 2. The hull ECU 20 acquires engine speeds of engines, included in the outboard motors 11R and 11L, via the outboard motor ECUs 13R and 13L. The hull ECU 20 provides data expressing target shift positions (forward drive, neutral, and reverse drive) and target engine speeds to the outboard motor ECUs 13R and 13L. Also, the hull ECU 20 provides target steering angles to the steering ECUs 14R and 14L via the inboard LAN 25. The steering ECUs 14R and 14L control steering actuators 53 (see FIG. 2) included in the steering units 12R and 12L to pivot the outboard motors 11R and 11L in right and left directions according to the target steering angles.

The hull ECU 20 performs control operations in accordance with a plurality of control modes including an ordinary maneuvering mode and a joystick maneuvering mode. A mode changeover switch 19 (mode switching unit) to switch between the ordinary maneuvering mode and the joystick maneuvering mode is included in the operation console 6.

In the ordinary maneuvering mode, the hull ECU 20 controls outputs of the outboard motors 11R and 11L and operations of the steering units 12R and 12L in accordance with operations of the steering wheel 15 and the remote control lever unit 16.

More specifically, the hull ECU 20 sets the target steering angles for the steering units 12R and 12L in accordance with an operation angle of the steering wheel 15. In this case, the target steering angles of the right and left steering units 12R and 12L are set to a common value. The right and left outboard motors 11R and 11L thus generate propulsive forces in mutually parallel directions. An operation angle sensor 21 is included and is arranged to detect the operation angle of the steering wheel 15. An output signal of the operation angle sensor 21 is input into the hull ECU 20.

The hull ECU 20 further controls outputs of the outboard motors 11R and 11L in accordance with the operation of the remote control lever unit 16. The remote control lever unit 16 includes a right lever 16R corresponding to the right outboard motor 11R and a left lever 16L corresponding to the left outboard motor 11L. The levers 16R and 16L are arranged to be tiltable in the front/rear direction. The tilt range includes a predetermined neutral range, a forward drive range in front of the neutral range, and a reverse drive range to the rear of the neutral range. When the levers 16R and 16L are positioned in the neutral range, the hull ECU 20 controls the corresponding outboard motors 11R and 11L so as not to generate a propulsive force. More specifically, the target shift positions of the corresponding outboard motors 11R and 11L are set to the neutral positions. When the levers 16R and 16L are positioned in the forward drive range, the hull ECU 20 controls the corresponding outboard motors 11R and 11L to apply forward drive direction propulsive forces to the hull 2. More specifically, the target shift positions of the corresponding outboard motors 11R and 11L are set to the forward drive positions. When the levers 16R and 16L are positioned in the reverse drive range, the hull ECU 20 controls the corresponding outboard motors 11R and 11L to apply reverse drive direction propulsive forces to the hull 2. More specifically, the target shift positions of the corresponding outboard motors 11R and 11L are set to the reverse drive positions. In the forward drive range and the reverse drive range, the hull ECU 20 controls the outboard motors 11R and 11L so that the greater the lever tilt amount from a neutral position (for example, a central position in the neutral range), the greater the propulsive forces generated. More specifically, the target engine speeds are set higher. The operation positions of the levers 16R and 16L are detected by lever position sensors 22R and 22L. Output signals of the lever position sensors 22R and 22L are provided to the hull ECU 20.

The joystick maneuvering mode is a control mode in which the steering angles of the steering units 12R and 12L and the outputs of the outboard motors 11R and 11L are controlled in response to operation of the joystick unit 10. In the joystick maneuvering mode, the hull ECU 20 makes the hull 2 move in the direction of tilt of the lever 7 and makes the hull 2 perform stem turning according to the pivoting operation amount of the knob 8. That is, the hull ECU 20 sets the target shift positions and the target engine speeds of the outboard motors 11R and 11L and the target steering angles of the steering units 12R and 12L to achieve such hull behavior.

Generally in the joystick maneuvering mode, the directions of the propulsive forces generated by the right and left outboard motors 11R and 11L are non-parallel. More specifically, in the joystick maneuvering mode, the steering angles of the steering units 12R and 12L are set so that rear end portions of the outboard motors 11R and 11L approach each other to define a V shape or so that the rear end portions move away from each other to define an inverted V shape. When the outboard motors 11R and 11L define a V shape, the lines of action 71R and 71L thereof also define a V shape. In this case, the lines of action intersect at a rear of the outboard motors 11R and 11L. When the outboard motors 11R and 11L define an inverted V shape, the lines of action 71R and 71L thereof also define an inverted V shape. In this case, the lines of action 71R and 71L intersect in front of the outboard motors 11R and 11L.

Figure 2:
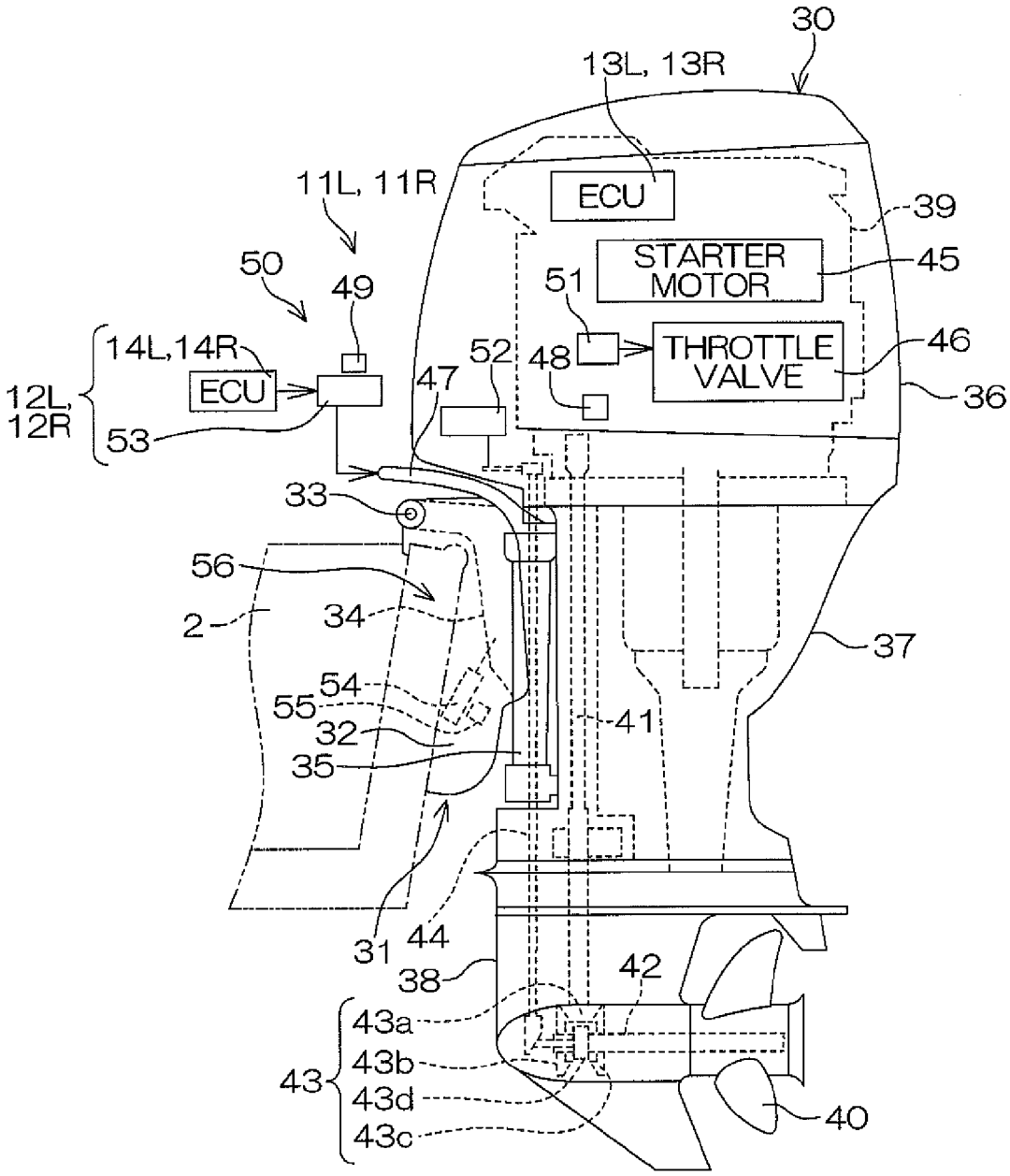
FIG. 2 is a schematic sectional view for explaining an arrangement of an outboard motor.

FIG. 2 is a schematic sectional view for explaining an arrangement in common to the outboard motors 11R and 11L. Each of the outboard motors 11R and 11L includes a propulsion unit 30 and an attachment mechanism 31 that attaches the propulsion unit 30 to the hull 2. The attachment mechanism 31 includes a clamp bracket 32 detachably fixed to a transom plate of the hull 2, and a swivel bracket 34 coupled to the clamp bracket 32 in a manner enabling pivoting about a tilt shaft 33 as a horizontal pivoting axis. The propulsion unit 30 is attached to the swivel bracket 34 in a manner enabling pivoting about a steering shaft 35. The steering angle (heading angle that the direction of the propulsive force forms with respect to the center line of the hull 2) can thereby be changed by pivoting the propulsion unit 30 about the steering shaft 35. Also, a trim angle of the propulsion unit 30 can be changed by pivoting the swivel bracket 34 about the tilt shaft 33. The trim angle corresponds to an angle of attachment of each of the outboard motors 11R and 11L with respect to the hull 2.

A housing of the propulsion unit 30 includes a top cowling 36, an upper case 37, and a lower case 38. An engine 39 is provided as a drive source in the top cowling 36 with an axis of a crankshaft thereof extending vertically. A driveshaft 41 for power transmission is coupled to a lower end of the crankshaft of the engine 39, and vertically extends through the upper case 37 into the lower case 38.

A propeller 40, which is a propulsive force generating member, is rotatably attached to a lower rear portion of the lower case 38. A propeller shaft 42, which is a rotation shaft of the propeller 40, extends horizontally in the lower case 38. The rotation of the driveshaft 41 is transmitted to the propeller shaft 42 via a shift mechanism 43, which is a clutch mechanism.

The shift mechanism 43 includes a drive gear 43*a*, a forward drive gear 43*b*, a reverse drive gear 43*c*, and a dog clutch 43*d*. The drive gear 43*a* is preferably a beveled gear fixed to a lower end of the driveshaft 41. The forward drive gear 43*b* is preferably a beveled gear rotatably disposed on the propeller shaft 42. The reverse drive gear 43*c* is likewise preferably a beveled gear rotatably disposed on the propeller shaft 42.

The dog clutch 43*d* is disposed between the forward drive gear 43*b* and the reverse drive gear 43*c*.

The forward drive gear 43*b* is meshed with the drive gear 43*a* from a forward side, and the reverse drive gear 43*c* is meshed with the drive gear 43*a* from a rear side. The forward drive gear 43*b* and the reverse drive gear 43*c* are thus rotated in mutually opposite directions.

The dog clutch 43*d* is in spline engagement with the propeller shaft 42. That is, the dog clutch 43*d* is axially slidable with respect to the propeller shaft 42, but is not rotatable relative to the propeller shaft 42 and thus rotates together with the propeller shaft 42.

The dog clutch 43*d* is slid along the propeller shaft 42 by axial pivoting of a shift rod 44, extending vertically parallel to the driveshaft 41. The shift position of the dog clutch 43*d* is thereby controlled to be set at a forward drive position at which it is engaged with the forward drive gear 43*b*, a reverse drive position at which it is engaged with the reverse drive gear 43*c*, or a neutral position at which it is not engaged with either the forward drive gear 43*b* or the reverse drive gear 43*c*.

When the dog clutch 43*d* is in the forward drive position, the rotation of the forward drive gear 43*b* is transmitted to the propeller shaft 42 via the dog clutch 43*d*. The propeller 40 is thereby rotated in one direction (forward drive direction) to generate a propulsive force in a direction of moving the hull 2 forward. On the other hand, when the dog clutch 43*d* is in the reverse drive position, the rotation of the reverse drive gear 43*c* is transmitted to the propeller shaft 42 via the dog clutch 43*d*. The reverse drive gear 43*c* is rotated in a direction opposite that of the forward drive gear 43*b*, and the propeller 40 is thus rotated in an opposite direction (reverse drive direction) to generate a propulsive force in a direction of moving the hull 2 in reverse. When the dog clutch 43*d* is in the neutral position, the rotation of the driveshaft 41 is not transmitted to the propeller shaft 42. That is, transmission of a driving force between the engine 39 and the propeller 40 is cut off so that no propulsive force is generated in either of the forward and reverse directions.

In relation to each engine 39, a starter motor 45 is disposed for starting the engine 39. The starter motors 45 are controlled by the outboard motor ECUs 13R and 13L. Also, a throttle actuator 51 is provided to actuate a throttle valve 46 of the engine 39 to change a throttle opening degree and thereby change an intake air amount of the engine 39. The throttle actuator 51 may be an electric motor, for example. The operations of the throttle actuators 51 are controlled by the outboard motor ECUs 13R and 13L. The engine 39 further includes an engine speed detecting section 48 arranged to detect the rotation of the crankshaft to detect the rotational speed of the engine 39.

Also, in relation to the shift rod 44, a shift actuator 52 (clutch actuator) arranged to change the shift position of the dog clutch 43*d* is provided. The shift actuators 52 are, for example, electric motors, and operations thereof are controlled by the outboard motor ECUs 13R and 13L.

Further, steering actuators 53, controlled by the steering ECUs 14L and 14R, are coupled to the steering rods 47 fixed to the propulsion units 30. The left steering unit 12L includes the left steering ECU 14L and the steering actuator 53 corresponding to the left outboard motor 11L. Likewise, the right steering unit 12R includes the right steering ECU 14R and the steering actuator 53 corresponding to the right outboard motor 11R.

The steering actuator 53 may include a DC servo motor and a speed reducer. Also, the steering actuator 53 may include a hydraulic cylinder that is driven by an electric pump. By driving the steering actuator 53, the propulsion unit 30 can be pivoted about the steering shaft 35 to perform the steering operation. Each of the steering units 12R and 12L is provided with a steering angle sensor 49 to detect the steering angle. The steering angle sensor 49 may include, for example, a potentiometer. Output signals of the steering angle sensors 49 are input into the steering ECUs 14R and 14L.

Also, a trim actuator (tilt trim actuator) 54 is provided between the clamp bracket 32 and the swivel bracket 34. The trim actuator 54 may include, for example, a hydraulic cylinder and is controlled by the corresponding outboard motor ECU 13R or 13L. The trim actuator 54 pivots the propulsion unit 30 about the tilt shaft 33 by pivoting the swivel bracket 34 about the tilt shaft 33. A trim mechanism 56 is thereby arranged to change the trim angle of the propulsion unit 30. The trim angle is detected by a trim angle sensor 55. An output signal of the trim angle sensor 55 is input in the corresponding outboard motor ECU 13R or 13L.

Figure 3A:
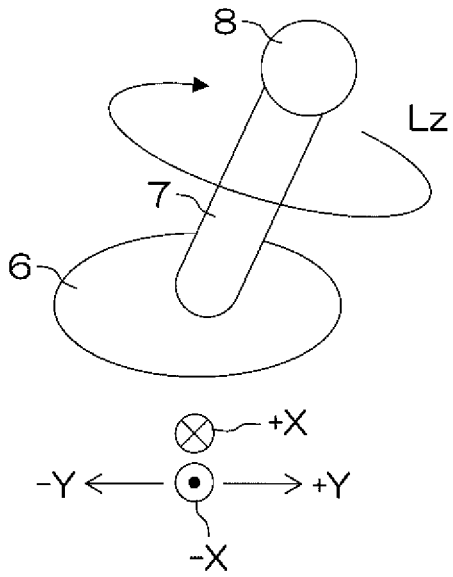
FIG. 3A is an enlarged schematic side view of an arrangement of a joystick unit.
Figure 3B:
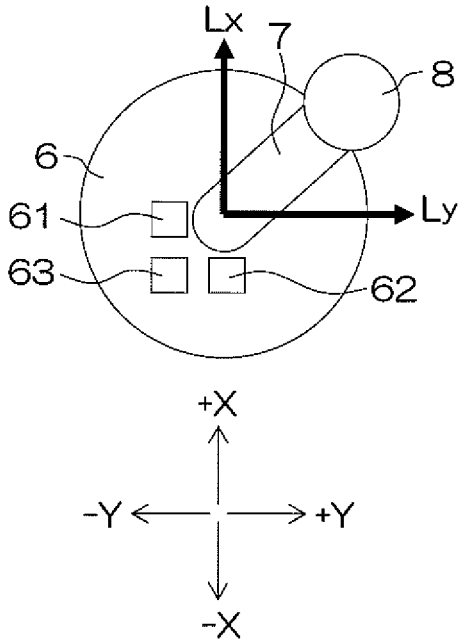
FIG. 3B is a plan view thereof.

FIG. 3A is an enlarged schematic side view of the arrangement of the joystick unit 10, and FIG. 3B is a plan view thereof. A direction directed from a top surface to a rear surface of the paper of FIG. 3A and a direction directed from a lower side to an upper side of the paper of FIG. 3B correspond to a forward drive direction +X of the marine vessel 1. A reverse drive direction −X, a right direction +Y, and a left direction −Y are indicated in the respective drawings based on the forward drive direction +X.

The lever 7 is protruded from the operation console 6 and is freely tiltable in any direction. A substantially spherical knob 8 is attached to a free end portion of the lever 7.

A neutral position of the lever 7 may be a position that is substantially perpendicular to a top surface of the operation console 6. A spring (not shown) that applies a restorative force directed toward the neutral position is coupled to the lever 7. When a marine vessel operator tilts the lever toward a desired direction from the neutral position, the hull ECU 20 controls the propulsive forces of the outboard motors 11R and 11L and the directions thereof based on the tilt position (tilt direction and tilt amount) of the lever 7. The marine vessel operator can thus control a heading speed and a heading direction of the marine vessel 1. When the marine vessel operator weakens the operation force applied to the lever 7, the lever 7 is returned to the neutral position by the restorative force of the spring.

The tilt amount $L_x$ of the lever 7 in the front/rear direction X (+X, −X) is detected by a first position sensor 61 included in the operation console 6 and is provided to the hull ECU 20. Likewise, the tilt amount $L_y$ of the lever 7 in the right/left direction Y (+Y, −Y) is detected by a second position sensor 62 included in the operation console 6 and is provided to the hull ECU 20.

Further, a third position sensor 63 for detecting a pivoting operation position (pivoting operation direction and pivoting operation amount) $L_z$ of the knob 8 is included in the operation console 6 and an output signal thereof is provided to the hull ECU 20. The first to third position sensors 61 to 63 may respectively include potentiometers. A spring (not shown) that applies a restorative force directed toward the neutral position is coupled to the knob 8. When the marine vessel operator weakens the operation force applied to the knob 8, the knob 8 is returned to the neutral position by the restorative force of the spring.

Figure 4:
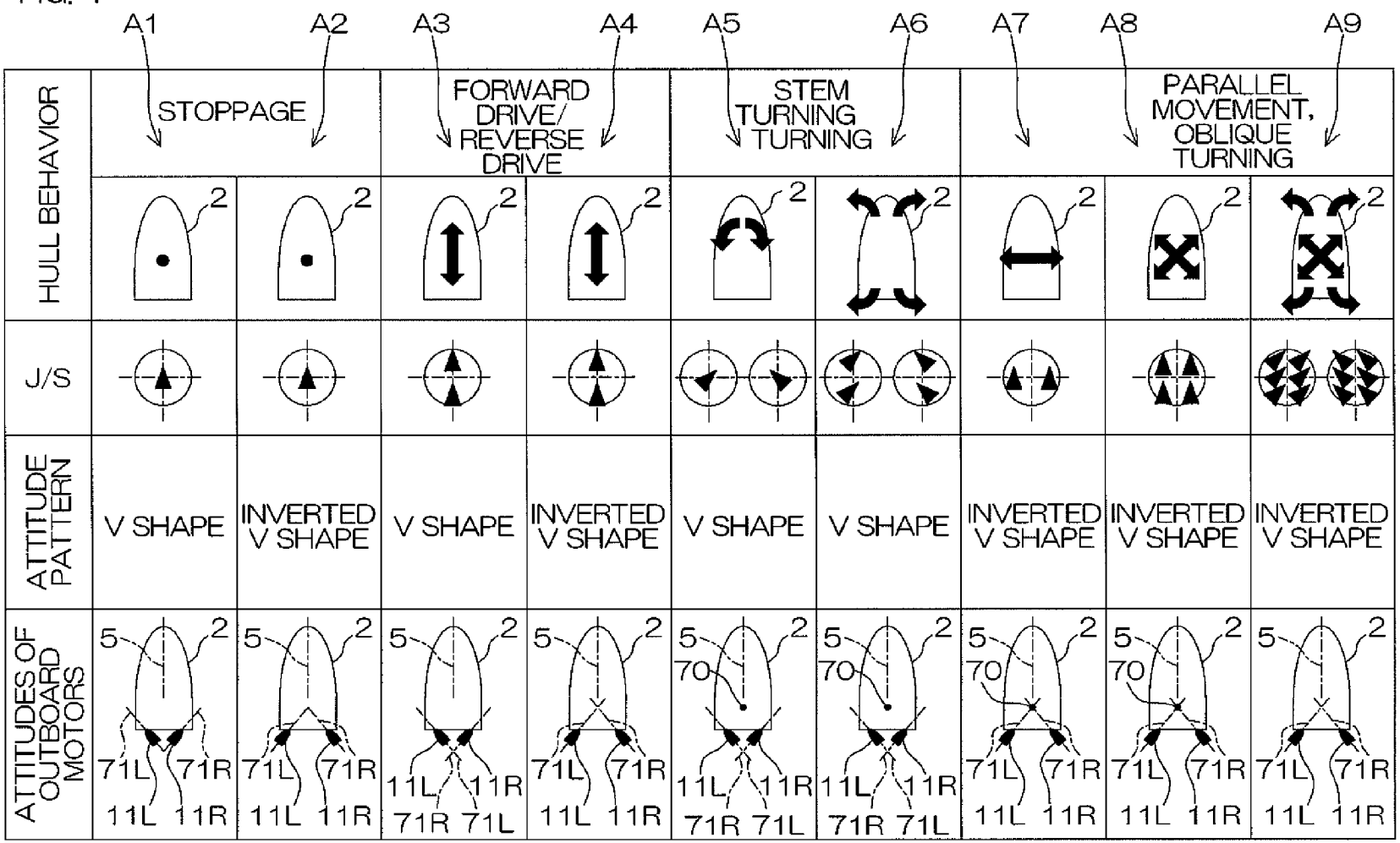
FIG. 4 is an operation explanation diagram showing behaviors of a hull and attitudes of outboard motors in a joystick maneuvering mode.

FIG. 4 is an operation explanation diagram showing behaviors of the hull 2 and attitudes of the outboard motors 11R and 11L in the joystick maneuvering mode. The lever tilt position of the joystick unit (J/S) 10 is expressed by a triangular symbol, "▲," indicated inside a circle. An intersection of cross lines is the neutral position of the lever 7. The pivoting operation position (pivoting angle) of the knob 8 is expressed by a direction of the triangular symbol, "▲." The neutral position of the knob 8 is the upward direction along the paper surface (direction parallel to the paper surface) in FIG. 4.

Operation examples A1 and A2 (stoppage) shown in FIG. 4 shall now be described. When the lever 7 and the knob 8 of the joystick unit (J/S) 10 are at the respective neutral positions, the right and left outboard motors 11R and 11L take on a first attitude pattern of defining a V shape in plan view or a second attitude pattern of forming an inverted V shape in plan view. That is, the right and left steering units 12R and 12L are controlled to take on such an attitude pattern. However, the shift positions of the outboard motors 11R and 11L are both controlled to be the neutral position, and thus neither of the outboard motors 11R and 11L generates a propulsive force. The hull 2 is thus maintained in a stopped state. The stopped state signifies a state where a propulsive force is not acting on the hull 2. The position of the hull 2 can thus change due to influence of a current flow or wind.

When the outboard motors 11R and 11L generate propulsive forces in the first attitude pattern, the lines of action 71R and 71L extending in the directions of the propulsive forces define a V shape that intersect at the rear of the outboard motors 11R and 11L. The steering angle of the left steering unit 12L thus takes on a positive value, and the steering angle of the right steering unit 12R takes on a negative value. When the outboard motors 11R and 11L generate propulsive forces in the second attitude pattern, the lines of action 71R and 71L that extend in the directions of the propulsive forces define an inverted V shape that intersect in front of the outboard motors 11R and 11L. The steering angle of the left steering unit 12L thus takes on a negative value, and the steering angle of the right steering unit 12R takes on a positive value.

Operation examples A3 and A4 (forward drive/reverse drive) shown in FIG. 4 shall now be described. Even when the lever 7 of the joystick unit 10 is tilted to the forward drive range or the reverse drive range without being tilted substantially in the right or left direction, the right and left steering units 12R and 12L are controlled so that the right and left outboard motors 11R and 11L likewise take on the first attitude pattern (V shape) or take on the second attitude pattern (inverted V shape). The shift positions of both outboard motors 11R and 11L are controlled to be at the forward drive positions if the lever 7 is in the forward drive range and are controlled to be at the reverse drive positions if the lever 7 is in the reverse drive range. Also, the engine speeds of the outboard motors 11R and 11L are controlled to values that are in accordance with the tilt amount of the lever 7 from the neutral position. A propulsive force in the forward drive direction or the reverse drive direction can thereby be applied to the hull 2 in accordance with the tilting of the lever 7 in the front or rear direction.

An operation example A5 (stem turning, turning) shown in FIG. 4 shall now be described. When the lever 7 of the joystick unit 10 is at its neutral position and the knob 8 is pivoted to the right or left from its neutral position, the right and left steering units 12R and 12L are controlled so that the outboard motors 11R and 11L take on the first attitude pattern (V shape). In the first attitude pattern (V shape), neither of the lines of action 71R and 71L of the outboard motors 11R and 11L passes through a rotation center 70 of the hull 2. The propulsive forces of the outboard motors 11R and 11L thus apply a moment (stem turning moment) about the rotation center 70 to the hull 2. In a state where the knob 8 is pivoted to the left relative to the neutral position, the shift position of the left outboard motor 11L is controlled to be at the reverse drive position and the shift position of the right outboard motor 11R is controlled to be at the forward drive position. A stem turning moment in a leftward turning direction (counterclockwise direction) is thereby applied to the hull 2. On the other hand, in a state where the knob 8 is pivoted to the right relative to the neutral position, the shift position of the left outboard motor 11L is controlled to be at the forward drive position and the shift position of the right outboard motor 11R is controlled to be at the reverse drive position. A stem turning moment in a rightward turning direction (clockwise direction) is thereby applied to the hull 2. Control is performed so that the greater the pivoting operation amount of the knob 8 from the neutral position, the higher the engine speeds of the outboard motors 11R and 11L and thus the greater the propulsive forces. The stem turning moment applied to the hull 2 is thereby increased and the stem turning speed increases.

An operation example A6 (stem turning, turning) shown in FIG. 4 shall now be described. Operation example A6 illustrates an operation when the lever 7 of the joystick unit 10 is in the forward drive range or the reverse drive range without being substantially tilted to the right or left direction and the knob 8 is pivoted to the right or left from its neutral position. In this case, the right and left steering units 12R and 12L are controlled so that the right and left outboard motors 11R and 11L take on the first attitude pattern (V shape). In this case, the engine speeds (propulsive forces) of the right and left outboard motors 11R and 11L are controlled so that the hull 2 is driven forward or in reverse while stem turning to the right or left. That is, in a state where the knob 8 is pivoted to the left relative to the neutral position, if the lever 7 is in the forward drive range, the hull 2 is driven forward while stem turning to the left (forward drive leftward turn) and if the lever 7 is in the reverse drive range, the hull 2 is driven in a left rearward direction while stem turning to the right (reverse drive leftward turn). On the other hand, in a state where the knob 8 is pivoted to the right relative to the neutral position, if the lever 7 is in the forward drive range, the hull 2 is driven forward while stem turning to the right (forward drive, rightward turn) and if the lever 7 is in the reverse drive range, the hull is driven in a right rearward direction while stem turning to the left (reverse drive, rightward turn).

Operation examples A7, A8, and A9 (parallel movement, oblique turning) shown in FIG. 4 shall now be described. When the knob 8 of the joystick unit 10 is at the neutral position and the lever 7 is tilted in any direction, the right and left steering units 12R and 12L are controlled so that the right and left outboard motors 11R and 11L take on the second attitude pattern (inverted V shape). In this case, the engine speeds of the right and left outboard motors 11R and 11L are controlled so that the hull 2 is driven parallel to the tilt direction of the lever 7. For example, if the lever 7 is not substantially tilted to the front or rear but is tilted in the right or left direction, the hull 2 undergoes parallel movement in the right direction or the left direction accordingly (operation example A7). Specifically, when the lever 7 is tilted in the left direction, the shift position of the left outboard motor 11L is controlled to be at the reverse drive position and the shift position of the right outboard motor 11R is controlled to be at the forward drive position. The respective engine speeds of the right and left outboard motors 11R and 11L are controlled so that the motors generate substantially equal propulsive forces. Consequently, a synthetic vector synthesized from the propulsive force vectors generated by the right and left outboard motors 11R and 11L is directed in the left direction orthogonal to the hull center line 5. Moreover, the lines of action 71R and 71L of the propulsive forces generated by the right and left outboard motors 11R and 11L both pass through the rotation center 70 of the hull and thus a stem turning moment does not act on the hull 2 substantially. The hull 2 thus moves to the left without stem turning substantially. Likewise, when the lever 7 is tilted in the right direction, the shift position of the left outboard motor 11L is controlled to be at the forward drive position and the shift position of the right outboard motor 11R is controlled to be at the reverse drive position. The respective engine speeds of the right and left outboard motors 11R and 11L are controlled so that the right and left outboard motors 11R and 11L generate substantially equal propulsive forces. Consequently, a synthetic vector synthesized from the propulsive force vectors generated by the right and left outboard motors 11R and 11L is directed in the right direction orthogonal to the hull center line 5. The hull 2 thus moves to the right without stem turning substantially.

When the lever 7 of joystick unit 10 is tilted obliquely left forward, the propulsive forces of the right and left outboard motors 11R and 11L are controlled so that the hull 2 undergoes an obliquely left forward parallel movement (operation example A8). That is, the shift positions and the engine speeds of the right and left outboard motors 11R and 11L are controlled so that the synthetic vector synthesized from the propulsive force vectors generated by the right and left outboard motors 11R and 11L is directed obliquely left forward. For example, the shift positions of the right and left outboard motors 11R and 11L are controlled to be at the forward drive position and the reverse drive position, respectively. The engine speeds of the right and left outboard motors 11R and 11L are controlled so that the propulsive force of the left outboard motor 11L is less than the propulsive force of the right outboard motor 11R. The synthetic vector of the propulsive forces is thus directed left forward and the hull 2 undergoes left forward parallel movement.

When the lever 7 of joystick unit 10 is tilted obliquely left rearward, the propulsive forces of the right and left outboard motors 11R and 11L are controlled so that the hull 2 undergoes an obliquely left rearward parallel movement (operation example A8). That is, the shift positions and the engine speeds of the right and left outboard motors 11R and 11L are controlled so that the synthetic vector synthesized from the propulsive force vectors generated by the right and left outboard motors 11R and 11L is directed obliquely left rearward. For example, the shift positions of the right and left outboard motors 11R and 11L are controlled to be at the forward drive position and the reverse drive position, respectively. The engine speeds of the right and left outboard motors 11R and 11L are controlled so that the propulsive force of the left outboard motor 11L is greater than the propulsive force of the right outboard motor 11R. The synthetic vector of the propulsive forces is thus directed left rearward and the hull 2 undergoes left rearward parallel movement.

When the lever 7 of joystick unit 10 is tilted obliquely right forward, the propulsive forces of the right and left outboard motors 11R and 11L are controlled so that the hull 2 undergoes an obliquely right forward parallel movement (operation example A8). That is, the shift positions and the engine speeds of the right and left outboard motors 11R and 11L are controlled so that the synthetic vector synthesized from the propulsive force vectors generated by the right and left outboard motors 11R and 11L is directed obliquely right forward. For example, the shift positions of the right and left outboard motors 11R and 11L are controlled to be at the reverse drive position and the forward drive position, respectively. The engine speeds of the right and left outboard motors 11R and 11L are controlled so that the propulsive force of the left outboard motor 11L is greater than the propulsive force of the right outboard motor 11R. The synthetic vector of the propulsive forces is thus directed right forward and the hull 2 undergoes right forward parallel movement.

When the lever 7 of joystick unit 10 is tilted obliquely right rearward, the propulsive forces of the right and left outboard motors 11R and 11L are controlled so that the hull 2 undergoes an obliquely right rearward parallel movement (operation example A8). That is, the shift positions and the engine speeds of the right and left outboard motors 11R and 11L are controlled so that the synthetic vector synthesized from the propulsive force vectors generated by the right and left outboard motors 11R and 11L is directed obliquely right rearward. For example, the shift positions of the right and left outboard motors 11R and 11L are controlled to be at the reverse drive position and the forward drive position, respectively. The engine speeds of the right and left outboard motors 11R and 11L are controlled so that the propulsive force of the left outboard motor 11L is less than the propulsive force of the right outboard motor 11R. The synthetic vector of the propulsive forces is thus directed right rearward and the hull 2 undergoes right rearward parallel movement.

When in addition to such a lever operation for parallel movement, a pivoting operation of the knob 8 is performed, the right and left outboard motors and the right and left steering units 12R and 12L are controlled so that the hull 2 undergoes stem turning in accordance with the pivoting operation of the knob 8 while moving in the tilt direction of the lever 7 (operation example A9). In this case, the steering units 12R and 12L are controlled so that at least one of the lines of action 71R and 71L of the propulsive forces generated by the right and left outboard motors 11R and 11L deviates from the hull rotation center 70. A stem turning moment is thereby applied to the hull 2 by the propulsive forces generated by the outboard motors 11R and 11L.

For example, the steering angles of the right and left steering units 12R and 12L when the lines of action 71R and 71L pass through the rotation center 70 of the hull 2 shall be indicated as $\theta_{L0}$ and $\theta_{R0}$, respectively ($\theta_{L0}<0$, $\theta_{R0}>0$). In this case, the steering angle $\theta_L$ of the left steering unit 12L is set to $\theta_L=\theta_{L0}\pm\Delta\theta_L$ ($\Delta\theta_L>0$), or the steering angle $\theta_R$ of the right steering unit 12R is set to $\theta_R=\theta_{R0}\pm\Delta\theta_R$ ($\Delta\theta_R>0$), or the two steering angles $\theta_L$ and $\theta_R$ are set to $\theta_L=\theta_{L0}\pm\Delta\theta_L$ and $\theta_R=\theta_{R0}\pm\theta\Delta_R$, respectively. More specifically, if when the shift positions of the outboard motors 11R and 11L are at the forward drive positions, either or both of $\theta_L=\theta_{L0}-\Delta\theta_L$ and $\theta_R=\theta_{R0}-\Delta\theta_R$ is or are set, a leftward turning moment can be applied to the hull 2. When the steering angles are set in likewise manner with the shift positions of the outboard motors 11R and 11L being at the reverse drive positions, a rightward turning moment can be applied to the hull 2. Also, if when the shift positions of the outboard motors 11R and 11L are at the forward drive positions, either or both of $\theta_L=\theta_{L0}+\Delta\theta_L$ and $\theta_R=\theta_{R0}+\Delta\theta_R$ is or are set, a rightward turning moment can be applied to the hull 2. When the steering angles are set in likewise manner with the shift positions of the outboard motors 11R and 11L being at the reverse drive positions, a leftward turning moment can be applied to the hull 2.

Figure 5:
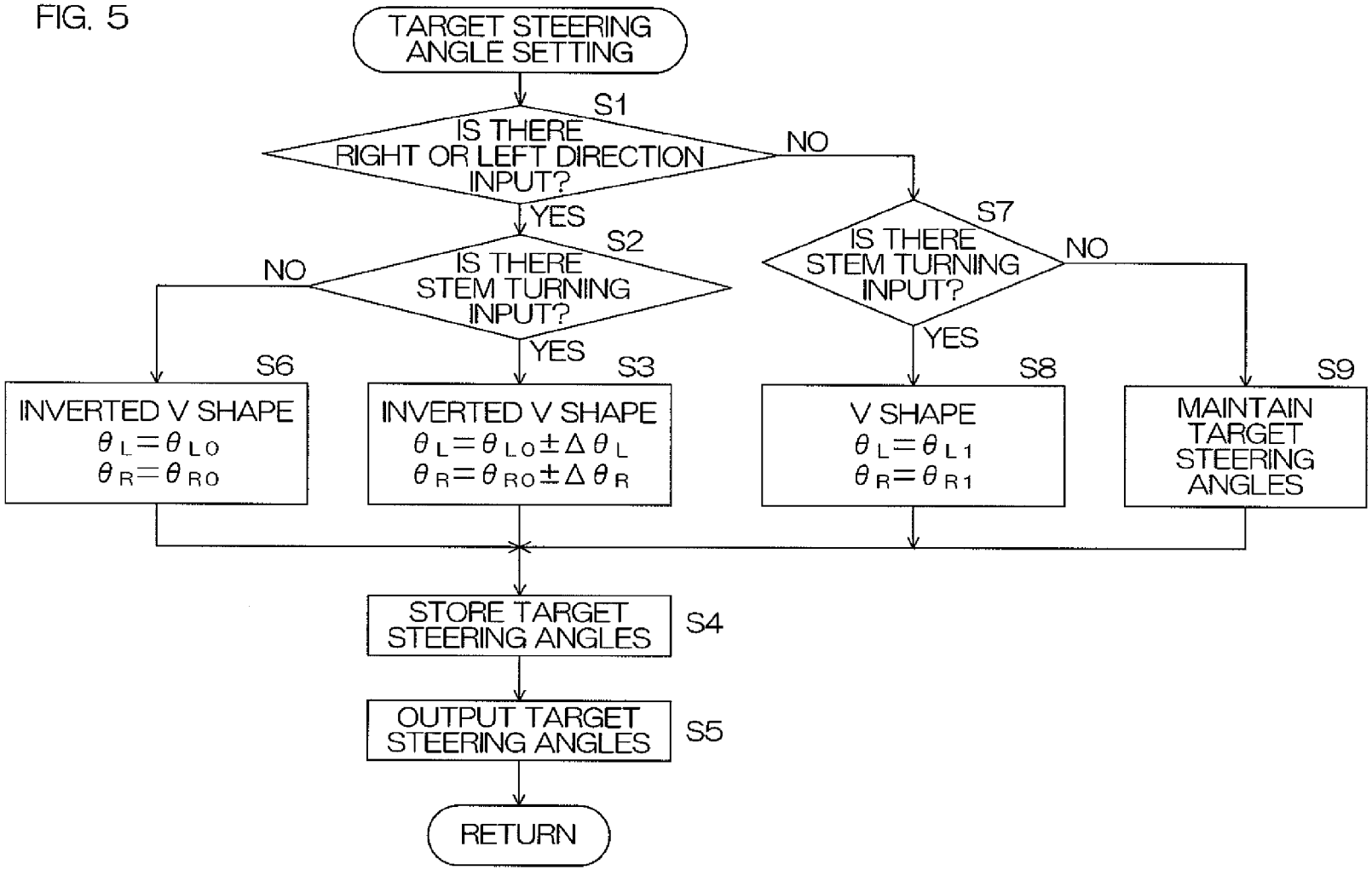
FIG. 5 is a flowchart of a portion of a process executed by a hull ECU in the joystick maneuvering mode.

FIG. 5 is a flowchart of a portion of a process executed by the hull ECU 20 in the joystick maneuvering mode and illustrates a process for setting the target steering angles of the right and left steering units 12R and 12L. The hull ECU 20 takes in the output of the joystick unit 10 and judges presence or non-presence of a right or left direction input (step S1). If the lever 7 is tilted in an oblique direction, the presence or non-presence of a right or left directional component thereof is judged. For example, the hull ECU 20 may be set with a dead zone of a predetermined width to the right and left from the neutral position. That is, the hull ECU 20 may be programmed to judge that there is a right or left direction input when the lever 7 is tilted to the right or left beyond the dead zone in the right/left direction.

If there is a right or left direction input (step S1: YES), the hull ECU 20 further judges the presence or non-presence of a pivoting operation input of the knob 8 (step S2). For example, the hull ECU 20 may be set with a predetermined dead zone for right and left pivoting operations from the neutral position. That is, the hull ECU 20 may be programmed to judge that there is a pivoting operation input when a pivoting operation in the right or left direction is performed beyond the dead zone.

If the hull ECU 20 judges that there is a pivoting operation input of the knob 8 (step S2: YES), the hull ECU 20 controls the steering units 12R and 12L and the outboard motors 11R and 11L in accordance with the operation example A9 described with FIG. 4 (step S3). That is, the hull ECU 20 sets the target steering angles of the steering units 12R and 12L so that the lines of action 71R and 71L of the propulsive forces of the outboard motors 11R and 11L define an inverted V shape. In this case, the target steering angles are set so that at least one of either of the lines of action 71R and 71L deviates from the rotation center 70 so that a stem turning moment that is in accordance with the pivoting operation amount of the knob 8 is generated. That is, the steering angles are set so that $\theta_L=\theta_{L0}\pm\Delta\theta_L$ or $\theta_R=\theta_{R0}\pm\Delta\theta_R$.

The hull ECU 20 writes the target steering angles set thus into a memory 20M included in the hull ECU 20 (step S4). The hull ECU 20 further provides the set target steering angles to the steering ECUs 14R and 14L via the inboard LAN 25 (step S5). The steering angles of the steering units 12R and 12L are thereby controlled to be at the target steering angles set as described above.

If it is judged that there is no pivoting operation input of the knob 8 (step S2: NO), the hull ECU 20 controls the steering units 12R and 12L and the outboard motors 11R and 11L in accordance with the second attitude pattern (inverted V shape attitudes) shown in FIG. 4 (step S6). That is, the hull ECU 20 sets the target steering angles of the steering units 12R and 12L so that the lines of action 71R and 71L of the propulsive forces of the outboard motors 11R and 11L define an inverted V shape and pass through the rotation center 70. Thereafter, the hull ECU 20 executes the process of steps S4 and S5. The steering angles $\theta_R$ and $\theta_L$ of the right and left steering units 12R and 12L are thereby guided so that $\theta_L=\theta_{L0}$ and $\theta_R=\theta_{R0}$. By controlling the propulsive forces (engine speeds) of the outboard motors 11R and 11L in this state, parallel movement of the hull 2 (operation example A7 or A8 of FIG. 4) is achieved.

If it is judged that the operation of the lever 7 in the right or left direction is not performed (step S1: NO), the hull ECU 20 further judges the presence or non-presence of a pivoting operation input of the knob 8 (step S7). The details of this judgment are the same as those of step S2.

If the hull ECU 20 judges that there is a pivoting operation input of the knob 8 (step S7: YES), the hull ECU 20 controls the steering units 12R and 12L and the outboard motors 11R and 11L in accordance with the first attitude pattern (V shape attitudes) shown in FIG. 4 (step S8). That is, the hull ECU 20 sets the target steering angles of the steering units 12R and 12L so that the lines of action 71R and 71L of the outboard motors 11R and 11L define a V shape. Thereafter, the hull ECU 20 executes the above-described process of steps S4 and S5. The steering angles $\theta_R$ and $\theta_L$ of the right and left steering units 12R and 12L are thereby guided, for example, so that $\theta_L=\theta_{L1}$ and $\theta_R=\theta_{R1}$ ($\theta_{L1}>0$; $\theta_{R1}<0$; for example, $\theta_{R1}=-\theta_{L1}$). By controlling the shift positions and the propulsive forces (engine speeds) of the outboard motors 11R and 11L in this state, on-the-spot stem turning (operation example A5 of FIG. 4) or turning (operation example A6 of FIG. 4) of the hull 2 is achieved.

If it is judged that the there is no pivoting operation input of the knob 8 (step S7: NO), the hull ECU 20 maintains the target steering angle stored in a previous control cycle (step S4) as it is (step S9). That is if the lever 7 is at the neutral position or if the lever 7 is tilted only in regard to the front/rear direction and the knob 8 is at the neutral position, the steering angles of the steering units 12R and 12L are not changed. In this state, the hull ECU 20 sets the target shift positions and the target engine speeds of the outboard motors 11R and 11L in accordance with the state of tilt of the lever 7 in the front/rear direction and provides these to the outboard motor ECUs 13R and 13L. The hull 2 is thereby put in the stopped state, forward drive state, or reverse drive state (operation examples A1, A2, A3, and A4 of FIG. 4).

That is, with the present preferred embodiment, when there is no need to perform stem turning of the hull 2 and there is no need to move the hull 2 in the right or left direction, the target steering angles are maintained at the previous values (operation examples A1 to A4 of FIG. 4). That is, when propulsive forces are not to be generated from the outboard motors 11R and 11L (when the target shift positions are to be set to the neutral positions), the target steering angles are maintained at the previous values (operation examples A1 and A2 of FIG. 4). Further, even when propulsive forces are to be generated from the outboard motors 11R and 11L, if a propulsive force in a right or left direction or a propulsive force for generating a stem turning moment is not required, the target steering angles are maintained at the previous values (operation examples A3 and A4 of FIG. 4). Occasions of actuation and actuation amounts of the steering units 12R and 12L can thereby be lessened and thus energy consumption by the steering actuators 53 can be lessened. A certain response time is necessary for the steering angles to actually change from the point in time at which the lever 7 or the knob 8 is operated. If within the response time, there is no right or left direction input due to the lever 7 and the knob 8 is put in the state of being positioned at the neutral position, the steering angle change is invalidated.

Figure 7A:
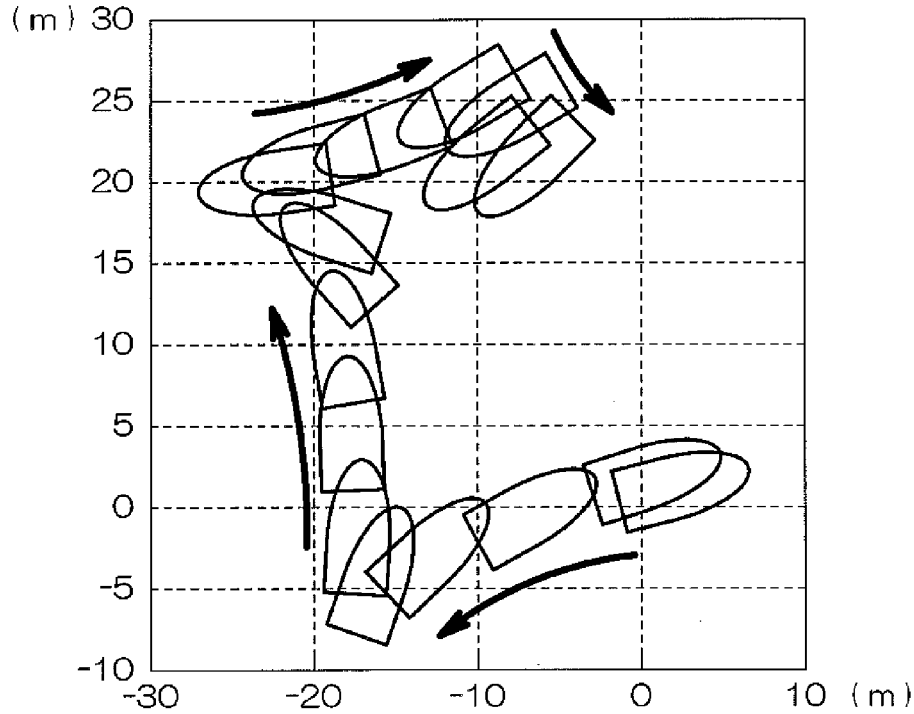
FIGS. 7A and 7B are diagrams of results of the experiment conducted by the present inventor in the joystick maneuvering mode.

FIG. 6A and FIG. 6B and FIG. 7A and FIG. 7B are diagrams of results of experiments conducted by the present inventor in the joystick maneuvering mode. FIGS. 6A and 7A show marine vessel tracks of the hull 2 during the experiments conducted with a comparative example and an example (having the arrangement of the preferred embodiment described above). In both experiments, the hull 2 is stopped after being driven in reverse, then stem turned leftward on the spot, thereafter driven forward, turned leftward, stopped, and after being driven in reverse further, moved laterally to the left and then stopped. That is, the marine vessel operator operated the lever 7 and knob 8 so that the hull 2 exhibits such behavior. To precisely control the attitude of the hull 2 while visually observing the behavior of the hull 2, the marine vessel operator frequently performed an operation of operating the lever 7 and the knob 8 from the respective neutral positions and returning these to the neutral positions.

Figure 7B:
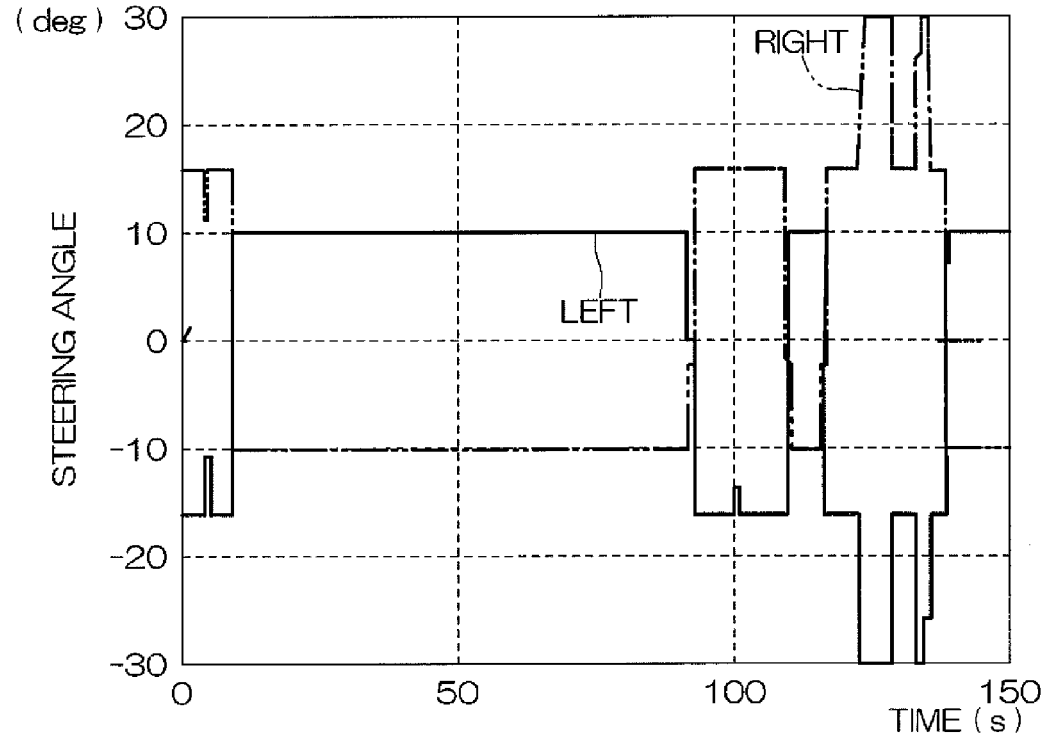

The experimental results for the comparative example are shown in FIG. 6B and the experimental results for the example are shown in FIG. 7B. More specifically, FIG. 6B and FIG. 7B show variations in time of the steering angles when marine vessel maneuvering is performed so as to draw the marine vessel tracks shown in FIG. 6A and FIG. 7A. The comparative example is not a prior art but is an arrangement example developed by the present inventor in a process of arriving at the completion of the present invention.

In the comparative example, the hull ECU 20 is programmed so that when the lever 7 is returned to the neutral position, the target steering angles of the steering units 12L and 12R are set to the neutral value (for example, zero). Further, in the comparative example, the hull ECU 20 is programmed to control the steering units 12R and 12L so that when the lever 7 is tilted only in regard to the front/rear direction, the outboard motors 11R and 11L take on the second attitude pattern (inverted V shape). The hull ECU 20 is programmed so that the operations during stem turning, turning, and parallel movement are the same as those of the present preferred embodiment (see FIG. 4). Thus, in the comparative example, each time the lever 7 and the knob 8 are returned to the neutral positions, the outboard motors 11R and 11L are returned to the neutral attitudes (attitudes of zero steering angle). When the lever 7 is tilted in the right or left direction or the knob 8 is pivoted to the right or left, the outboard motors 11R and 11L are steered to the inverted V shape or V shape attitude.

As is clear from a comparison of FIG. 6B and FIG. 7B, whereas the outboard motors 11R and 11L are steered frequently in the comparative example, the steering of the outboard motors 11R and 11L is lessened in the example. Specifically, the number of times the steering actuators 53 were actuated in response to operations of the joystick unit 10 was 38 times in the comparative example and 5 times in the example. The number of times of actuation of the steering actuators 53 is thus reduced to about 13.2% of the comparison example. The total steering amount (total of the angles of steering) of the outboard motors 11R and 11L was approximately 550 degrees in the comparative example and approximately 200 degrees in the example. The total steering amount of the example is thus reduced to about 36.2% of the comparative example. It can thus be understood that the occasions of actuation and actuation amounts of the steering actuators 53 are significantly reduced and a contribution can be made to energy savings in the example.

During leaving and docking, etc., the marine vessel operator may repeatedly perform an operation of tilting the lever 7 from the neutral position for just a short time to perform parallel movement of the marine vessel 1 a little at a time (operation examples A7 and A8 of FIG. 4). In this case, when the lever 7 is returned to the neutral position, the steering angles of the right and left outboard motors 11R and 11L are maintained as they are and the state where the lines of action 71R and 71L define the inverted V shape is maintained. That is, the steering angles do not change frequently between the neutral value and the values at which the lines of action 71R and 71L define the inverted V shape. Also, during leaving and docking, etc., the marine vessel operator may repeatedly perform an operation of pivoting the knob 8 for just a short time to perform stem turning of the marine vessel 1 a little at a time (operation example A5 of FIG. 4). In this case, when the knob 8 is returned to the neutral position and the propulsive forces from the outboard motors 11R and 11L are thus stopped, the steering angles of the right and left outboard motors 11R and 11L are maintained as they are and the state where the lines of action 71R and 71L define the V shape is maintained. That is, the steering angles do not change frequently between the neutral value and the values at which the lines of action 71R and 71L define the V shape.

Meaningless changes of the steering angles are thus lessened to enable a contribution to be made to energy efficiencies of the steering units 12R and 12L.

Second Preferred Embodiment

Figure 8:
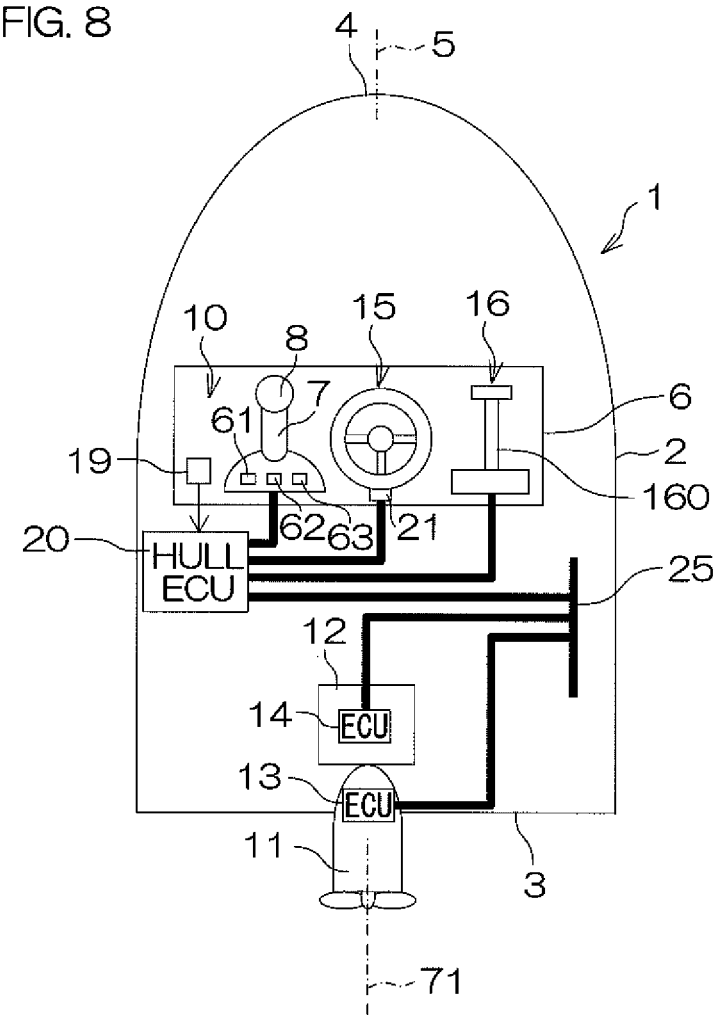
FIG. 8 is a schematic diagram for explaining an arrangement of a marine vessel according to a second preferred embodiment of the present invention.

FIG. 8 is a schematic diagram for explaining an arrangement of a marine vessel according to a second preferred embodiment of the present invention. In FIG. 8, portions corresponding to respective portions shown in FIG. 1 are indicated by the same reference symbols. The marine vessel 1 of the present preferred embodiment is a single-motor-mounted outboard motor craft having a single outboard motor 11 provided at the stern. The outboard motor 11 is attached, for example, to the stern 3 along the center line 5 of the hull 2. The arrangement of the outboard motor 11 is the same as the arrangement of each of the outboard motors 11R and 11L in the first preferred embodiment. A steering unit 12 is included in correspondence to the outboard motor 11. The steering unit 12 is arranged to pivot the outboard motor 11 to the right and left with respect to the hull 2. The specific arrangement of the steering unit 12 is preferably the same as that of each of the steering units 12R and 12L in the first preferred embodiment.

The remote control lever unit 16 includes a single lever 160 corresponding to the single outboard motor 11. The shift position and the engine speed of the outboard motor 11 can be controlled by tilting the lever 160 to the front or the rear from the neutral position.

The hull ECU 20 controls operations of the single outboard motor 11 and the corresponding single steering unit 12. As in the first preferred embodiment, the hull ECU 20 performs control operations in accordance with a plurality of control modes including the ordinary maneuvering mode and the joystick maneuvering mode. The switching between the ordinary maneuvering mode and the joystick maneuvering mode is performed in response to the mode changeover switch 19 that is operated by the marine vessel operator.

In the ordinary maneuvering mode, the hull ECU 20 controls the output of the outboard motor 11 and the operation of the steering unit 12 in accordance with operations of the steering wheel 15 and the remote control lever unit 16. Specifically, the hull ECU 20 sets the target steering angle for the steering unit 12 in accordance with the operation angle of the steering wheel 15. The hull ECU 20 further controls the output of the outboard motor 11 in accordance with the operation of the remote control lever unit 16. Details of the control corresponding to the operation of the remote control lever unit 16 are the same as in the case of the first preferred embodiment.

The joystick maneuvering mode is the control mode in which the steering angle of the steering unit 12 and the output of the outboard motor 11 are controlled in response to the operation of the joystick unit 10. However, in the present preferred embodiment, only tilting in the front/rear direction is effective as the operation of the lever 7, and the hull ECU 20 is programmed so that tilting of the lever 7 in the right/left direction is not taken into account in the control. In the joystick maneuvering mode, the hull 2 moves in the tilt direction (to the front or rear) of the lever 7 and the hull 2 stem-turns at an angular speed that is in accordance with the pivoting operation amount of the knob 8 and the target engine speed. The hull ECU 20 sets the target shift position of the outboard motor 11 and the target steering angle of the steering unit 12 to achieve such hull behavior.

Figure 9:
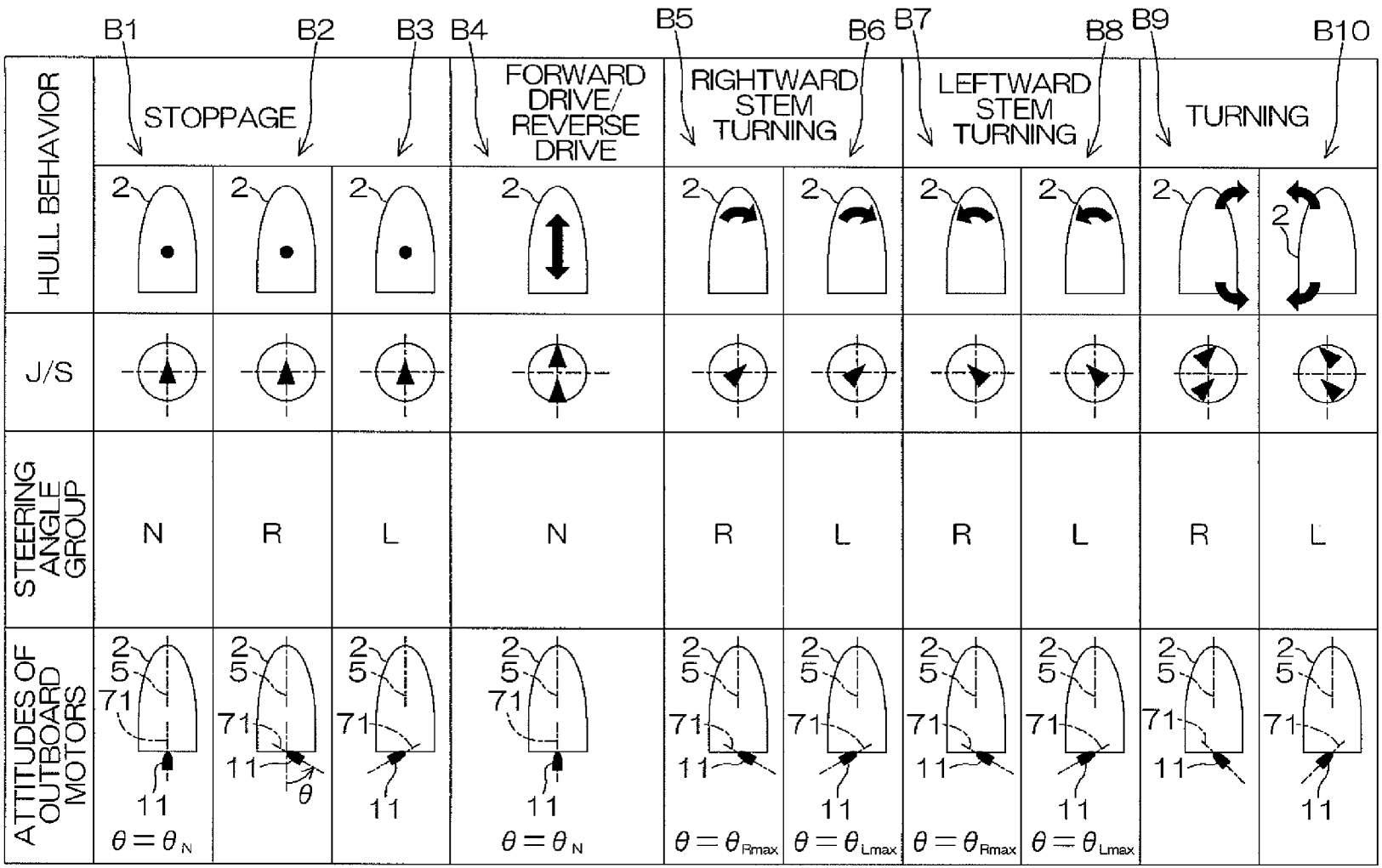
FIG. 9 is an operation explanation diagram showing the behaviors of the hull and the attitudes of the outboard motor in the joystick maneuvering mode of the second preferred embodiment of the present invention.

FIG. 9 is an operation explanation diagram showing the behaviors of the hull 2 and the attitudes of the outboard motor 11 in the joystick maneuvering mode, and the illustration is made in the same manner as in FIG. 4. In the present preferred embodiment, the steering angle θ of the steering unit 12 is classified according to three steering angle groups (steering angle ranges) in the joystick maneuvering mode. A first steering angle group N (neutral range) includes the steering angle that satisfies $\theta=\theta_N$ (for example, $\theta_N=0_0$; neutral value). The second steering angle group L is a group of steering angles (first steering angle range) that satisfy $\theta_{Lmax}\leq\theta<0$. The third steering angle group R is a group of steering angles (second steering angle range) that satisfies $0<\theta\leq\theta_{Rmax}$. $\theta_{Lmax}$ is the steering angle (left maximum steering angle) when the rear end portion of the outboard motor 11 is swung maximally to the left side. $\theta_{Rmax}$ is the steering angle (right maximum steering angle) when the rear end portion of the outboard motor 11 is swung maximally to the right side. For example, $|\theta_{Lmax}|=|\theta_{Rmax}|$.

For example, when the steering angle θ belongs to the first steering angle group N ($\theta=\theta_N$), the outboard motor 11 is in the neutral attitude in which a line of action 71 of the propulsive force thereof is parallel to the hull center line 5 (operation examples B1 and B4). Thus, when in this state, the shift position of the outboard motor 11 is controlled to be at the forward drive position, the hull 2 is driven forward along the hull center line 5 (operation example B4). Also, when the shift position of the outboard motor 11 is controlled to be at the reverse drive position, the hull 2 is driven in reverse along the hull center line 5 (operation example B4).

When the steering angle θ belongs to the second steering angle group L ($\theta_{Lmax}\leq\theta<0$), the outboard motor 11 is in an attitude in which the line of action 71 thereof is directed to the right relative to the rotation center 70 of the hull 2 (operation examples B3, B6, B8, and B10). Thus, when the shift position of the outboard motor 11 is controlled to be at the forward drive position, the hull 2 undergoes a forward drive leftward turn (stem turning leftward while being driven forward) (operation example B10). Also, when the shift position of the outboard motor 11 is controlled to be at the reverse drive position, the hull 2 undergoes a reverse drive leftward turn (stem turning rightward while being driven in reverse and moving toward the left rear) (operation example B10). In particular, when the shift position of the outboard motor 11 is controlled to be at the forward drive position when $\theta=\theta_{Lmax}$, the hull 2 undergoes leftward stem turning about the rotation center 70 at a smaller rotation radius while hardly changing in position (operation example B8). Also, when the shift position of the outboard motor 11 is controlled to be at the reverse drive position, the hull 2 undergoes rightward stem turning about the rotation center 70 at a smaller rotation radius while hardly changing in position (operation example B6).

When the steering angle θ belongs to the third steering angle group R ($0<\theta\leq\theta_{Rmax}$), the outboard motor 11 is in an attitude in which the line of action 71 thereof is directed to the left relative to the rotation center 70 of the hull 2 (operation examples B2, B5, B7, and B9). Thus, when the shift position of the outboard motor 11 is controlled to be at the forward drive position, the hull 2 undergoes a forward drive rightward turn (stem turning rightward while being driven forward) (operation example B9). Also, when the shift position of the outboard motor 11 is controlled to be at the reverse drive position, the hull 2 undergoes a reverse drive rightward turn (stem turning leftward while being driven in reverse and moving toward the right rear) (operation example B9). In particular, when the shift position of the outboard motor 11 is controlled to be at the forward drive position when $\theta=\theta_{Rmax}$, the hull 2 undergoes rightward stem turning about the rotation center 70 at a smaller rotation radius while hardly changing in position (operation example B5). Also, when the shift position of the outboard motor 11 is controlled to be at the reverse drive position, the hull 2 undergoes leftward stem turning about the rotation center 70 at a smaller rotation radius while hardly changing in position (operation example B7).

When the lever 7 and the knob 8 of the joystick unit 10 are at the respective neutral positions (operation examples B1, B2, and B3), the steering angle θ of the steering unit 12 takes on a value belonging to one among the first steering angle group N, the second steering angle group L and the third steering angle group R. Put in another way, when the lever 7 and the knob 8 are at the respective neutral positions, any steering angle is allowed. The hull ECU 20 sets the target steering angle of the steering unit 12 to maintain the attitude of the outboard motor 11 immediately before the lever 7 and the knob 8 are set at the respective neutral positions. Further, the hull ECU 20 sets the target shift position of the outboard motor 11 at the neutral position. An initial value of the steering angle θ in the joystick maneuvering mode is $\theta=\theta_N$. The steering angle group immediately after switching to the joystick maneuvering mode is the first steering angle group N. The hull ECU 20 is programmed to write information expressing the current steering angle group into its memory 20M.

When the lever 7 of the joystick unit 10 is tilted to the forward drive range or the reverse drive range and the knob 8 is at its neutral position (operation example B4), the hull ECU 20 sets the target steering angle of the steering unit 12 to zero. The steering angle of the steering unit 12 is thereby guided to $\theta=\theta_N$. Also, the hull ECU 20 sets the target shift position and the target engine speed of the outboard motor 11 in accordance with the tilt amount in the front/rear direction of the lever 7. That is, the hull ECU 20 sets the target shift position at the forward drive position if the lever 7 is tilted to the forward drive range, and sets the target shift position at the reverse drive position if the lever 7 is tilted to the reverse drive range. The hull ECU 20 further sets the target engine speed in accordance with the tilt amount from the neutral position.

Operations in cases where the lever 7 of the joystick unit 10 is at the neutral position (at least the neutral position in relation to the front/rear direction) and the knob 8 is pivoted to the right or left from its neutral position are illustrated by the operation examples B5 to B8. That is, the hull ECU 20 sets the target steering angle of the steering unit 12 so that $\theta=\theta_{Lmax}$ or $\theta=\theta_{Rmax}$. Which of the steering angles is selected depends on the steering angle group that is selected immediately before. That is, if the immediately prior steering angle group is the second steering angle group L, θ is set so that $\theta=\theta_{Lmax}$, and if the immediately prior steering angle group is the third steering angle group R, θ is set so that $\theta=\theta_{Rmax}$. The steering angle change amount is thereby minimized. If the immediately prior steering angle group is the first steering angle group N, the steering angle θ may be controlled to either of left maximum steering angle $\theta_{Lmax}$ and right maximum steering angle $\theta_{Rmax}$. Which steering angle is selected may be determined in advance.

Operations in cases where the lever 7 of the joystick unit 10 is in the forward drive range or the reverse drive range and the knob 8 is pivoted to the right or left from the neutral position are illustrated by the operation examples B9 and B10. That is, the hull ECU 20 sets the target steering angle of the steering unit 12 so that the steering angle θ belongs to the second steering angle group L or the third steering angle group R. If the lever 7 is in the forward drive range, the hull ECU 20 sets the target shift position at the forward drive position, and if the lever 7 is in the reverse drive range, the hull ECU 20 sets the target shift position at the reverse drive position.

To describe more specifically, when the lever 7 is in the forward drive range and the knob 8 is pivoted in the left direction from the neutral position (operation example B10), the steering angle θ is controlled to be in the second steering angle group L. Consequently, the outboard motor 11 generates the propulsive force so as to make the hull 2 undergo a forward drive leftward turn. Likewise, when the lever 7 is in the reverse drive range and the knob 8 is pivoted in the left direction from the neutral position (operation example B10), the steering angle θ is controlled to be in the second steering angle group L. Consequently, the outboard motor 11 makes the hull 2 undergo a reverse drive leftward turn (stem turning rightward while being driven in reverse and moving toward the left rear). In these cases, the steering angle θ is variably set within the range of $\theta_{Lmax} \leq \theta < 0$ in accordance with the pivoting amount of the knob 8 from the neutral position.

On the other hand, when the lever 7 is in the forward drive range and the knob 8 is pivoted in the right direction from the neutral position (operation example B9), the steering angle θ is controlled to be in the third steering angle group R. Consequently, the outboard motor 11 generates the propulsive force so as to make the hull 2 undergo a forward drive rightward turn. Likewise, when the lever 7 is in the reverse drive range and the knob 8 is pivoted in the right direction from the neutral position (operation example B9), the steering angle θ is controlled to be in the third steering angle group R. Consequently, the outboard motor 11 makes the hull 2 undergo a reverse drive rightward turn (stem turning leftward while being driven in reverse and moving toward the right rear). In these cases, the steering angle θ is variably set within the range of $0 \leq \theta \leq \theta_{Rmax}$ in accordance with the pivoting amount of the knob 8 from the neutral position.

Figure 10:
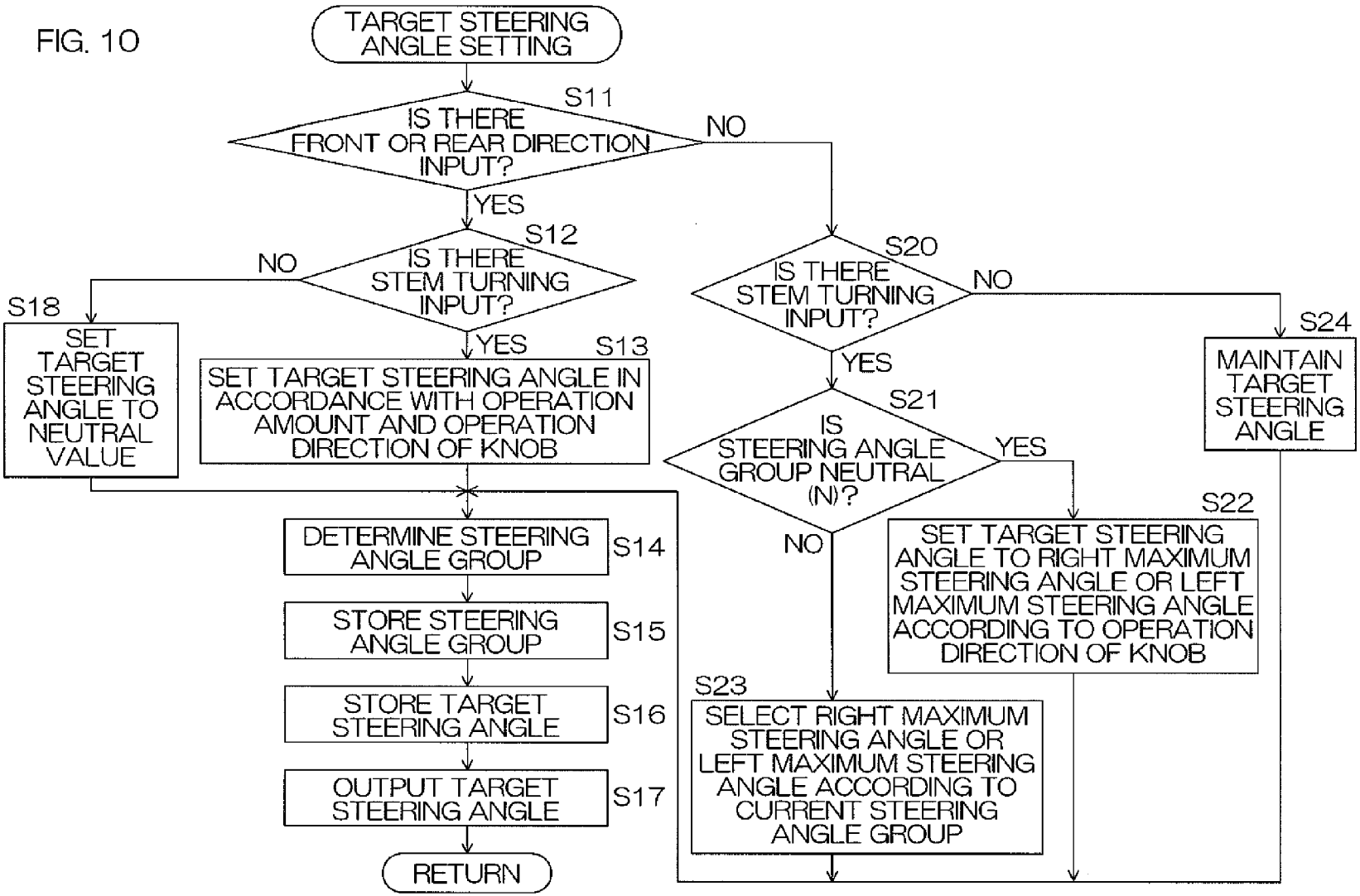
FIG. 10 is a flowchart of a portion of a process executed by the hull ECU in the joystick maneuvering mode of the second preferred embodiment of the present invention.

FIG. 10 is a flowchart of a portion of a process executed by the hull ECU 20 in the joystick maneuvering mode and mainly illustrates a process for setting the target steering angle of the steering unit 12. The hull ECU 20 takes in the output of the joystick unit 10 and judges presence or non-presence of a front or rear direction input (step S11). If the lever 7 is tilted in an oblique direction, the presence or non-presence of a front or rear directional component thereof is judged. That is, the hull ECU 20 is programmed to judge that there is a front or rear direction input when the lever 7 is tilted to the forward drive range or the reverse drive range.

If there is a front or rear direction input, the hull ECU 20 further judges the presence or non-presence of a pivoting operation input of the knob 8 (step S12). This judgment may be made in the same manner as in the first preferred embodiment (see step S2 of FIG. 5).

If the hull ECU 20 judges that there is a pivoting operation input of the knob 8 (step S12: YES), it executes the control operation in accordance with the operation example B9 or B10 explained with FIG. 9. That is, the hull ECU 20 sets the target steering angle for the steering unit 12 and the target shift position and the target engine speed for the outboard motor 11 to achieve such hull behavior. Specifically, the target steering angle that is in accordance with the pivoting operation amount and the pivoting operation direction of the knob 8 is set (step S13). The hull 2 can thereby be made to turn rightward or leftward at the stem turning speed that is in accordance with the pivoting operation amount of the knob 8 while being driven forward or in reverse. The hull ECU 20 further judges which of the first steering angle group N, the second steering angle group L, and the third steering angle group R the target steering angle belongs to (step S14). In accordance with the judgment, the steering angle group information expressing the corresponding steering angle group is written into the memory 20M (step S15). Further, the hull ECU 20 writes the set target steering angle into the memory 20M (step S16). The hull ECU 20 then provides the set target steering angle to the steering ECU 14 via the inboard LAN 25 (step S17). The steering angle of the steering unit 12 is thereby controlled to be the set target steering angle.

If it is judged that there is no pivoting operation input of the knob 8 (step S12: NO), the hull ECU 20 sets the target steering angle to the neutral value $\theta_N$ (step S18). Further, the hull ECU 20 writes the information expressing the first steering angle group N into the memory 20M (steps S14 and S15). Thereafter, the process from step S16 is performed. The steering angle θ of the steering unit 12 is thereby guided so that $\theta = \theta_N$ (=0). By the propulsive force (engine speed) of the outboard motor 11 being controlled in this state, the hull 2 moves to the front or rear.

If it is judged that the lever 7 is not operated in the front or rear direction (step S11: NO), the hull ECU 20 further judges for the presence or non-presence of the pivoting operation input of the knob 8 (step S20). This judgment is made in the same manner as in the judgment in step S12.

If the hull ECU 20 judges that there is a pivoting operation input of the knob 8 (step S20: YES), it references the memory 20M and judges whether or not the current steering angle group is the first steering angle group N (neutral range) (step S21). If the current steering angle group is the first steering angle group N (step S21: YES), the target steering angle is set to the left maximum steering angle $\theta_{Lmax}$ or the right maximum steering angle $\theta_{Rmax}$ according to the pivoting direction of the knob 8 (step S22). Specifically, if the knob 8 is pivoted to the left from the neutral position, the target steering angle is set to the left maximum steering angle $\theta_{Lmax}$ Also, if the knob 8 is pivoted to the right from the neutral position, the target steering angle is set to the right maximum steering angle $\theta_{Rmax}$. In this case, the hull ECU 20 sets the target shift position to the forward drive position. Thereafter, the hull ECU 20 executes the process from step S14.

If in step S21, it is judged that the current steering angle group is not the first steering angle group N (neutral range), the hull ECU 20 sets the target steering angle so as to maintain the current steering angle group (step S26). That is, the steering angle group is not changed.

That is, if the current steering angle group is the second steering angle group L, the hull ECU 20 sets the target steering angle to the left maximum steering angle $\theta_{Lmax}$. In this case, the hull ECU 20 sets the target shift position of the outboard motor 11 to the forward drive position or the reverse drive position in accordance with the pivoting direction of the knob 8 from the neutral position. Specifically, if the knob 8 is pivoted in the left direction from the neutral position, the hull ECU 20 sets the target shift position to the forward drive position. A leftward turning moment is thereby applied to the hull 2. If the knob 8 is pivoted in the right direction from the neutral position, the hull ECU 20 sets the target shift position to the reverse drive position. A rightward turning moment is thereby applied to the hull 2.

On the other hand, if the current steering angle group is the third steering angle group R, the hull ECU 20 sets the target steering angle to the right maximum steering angle $\theta_{Rmax}$. In this case, the hull ECU 20 sets the target shift position of the outboard motor 11 to the forward drive position or the reverse drive position in accordance with the pivoting direction of the knob 8 from the neutral position. Specifically, if the knob 8 is pivoted in the left direction from the neutral position, the hull ECU 20 sets the target shift position to the reverse drive position. A leftward turning moment is thereby applied to the hull 2. If the knob 8 is pivoted in the right direction from the neutral position, the hull ECU 20 sets the target shift position to the forward drive position. A rightward turning moment is thereby applied to the hull 2.

If it is judged there is not pivoting operation input of the knob 8 (step S20: NO), the hull ECU 20 maintains the target steering angle set and stored in the previous control cycle (step S16) as it is (step S24). Obviously, the steering angle group is not changed. That is, when the lever is at the neutral position at least in regard to the front/rear direction and the knob 8 is also at the neutral position (dead zone range), the steering angle of the steering unit 12 is not changed. In this case, the hull ECU 20 sets the target shift position to the neutral position and sets the target engine speed to the idling speed. The hull 2 is thereby put in a stopped state in which it does not receive a propulsive force from the outboard motor 11.

According to the present preferred embodiment, when a propulsive force is not to be generated from the outboard motor 11, that is, when the target shift position is to be set at the neutral position, the target steering angle is maintained at the previous value. Also, with the present preferred embodiment, when there is no front or rear direction input from the lever 7, the steering angle group in the previous control cycle is maintained. The occasions of actuation and actuation amounts of the steering actuator 53 are thereby minimized. Consequently, energy consumption required for actuation of the steering actuator 53 can be lessened.

Third Preferred Embodiment

Figure 11:
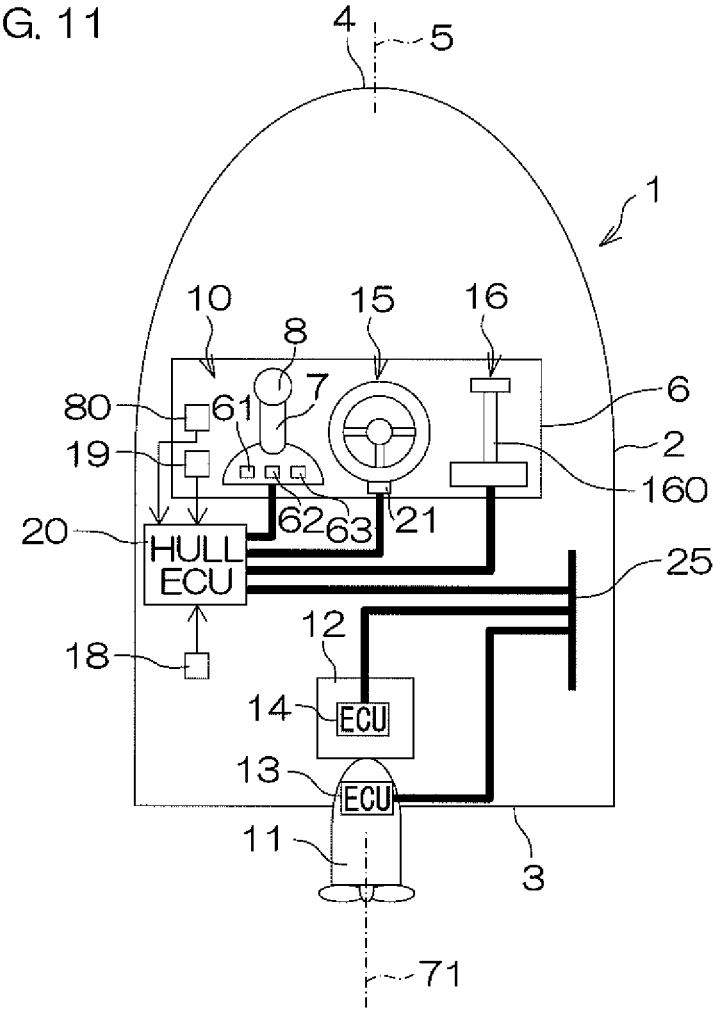
FIG. 11 is a schematic diagram for explaining an arrangement of a marine vessel according to a third preferred embodiment of the present invention.

FIG. 11 is a schematic diagram for explaining an arrangement of a marine vessel according to a third preferred embodiment of the present invention. In FIG. 11, portions equivalent to respective portions shown in FIG. 8 are indicated by the same reference symbols. In the present preferred embodiment, in addition to the arrangement shown in FIG. 8, a heading maintenance button 80 (heading maintenance commanding unit) is included in the operation console 6, and further, an output signal of a heading sensor 18 (heading detecting unit) is input into the hull ECU 20. The heading sensor 18 is a sensor that is arranged to detect an orientation (heading) of the hull 2, and may, for example, include a gyro sensor.

The hull ECU 20 is programmed to execute a control operation of maintaining the heading of the hull 2 when the heading maintenance button 80 is operated. The heading sensor 18 is arranged to detect the heading of the hull 2. The heading of the hull 2 refers to the direction from the stern to stem along the hull center line 5. Heading maintenance of the hull 2 is a hull behavior that is desirable in a case of performing fishing while letting the hull 2 move along with a current flow while maintaining the heading of the hull 2 (drift fishing), in a case of making the hull 2 run at low speed while maintaining the heading of the hull 2 (trolling), etc.

Figure 12:
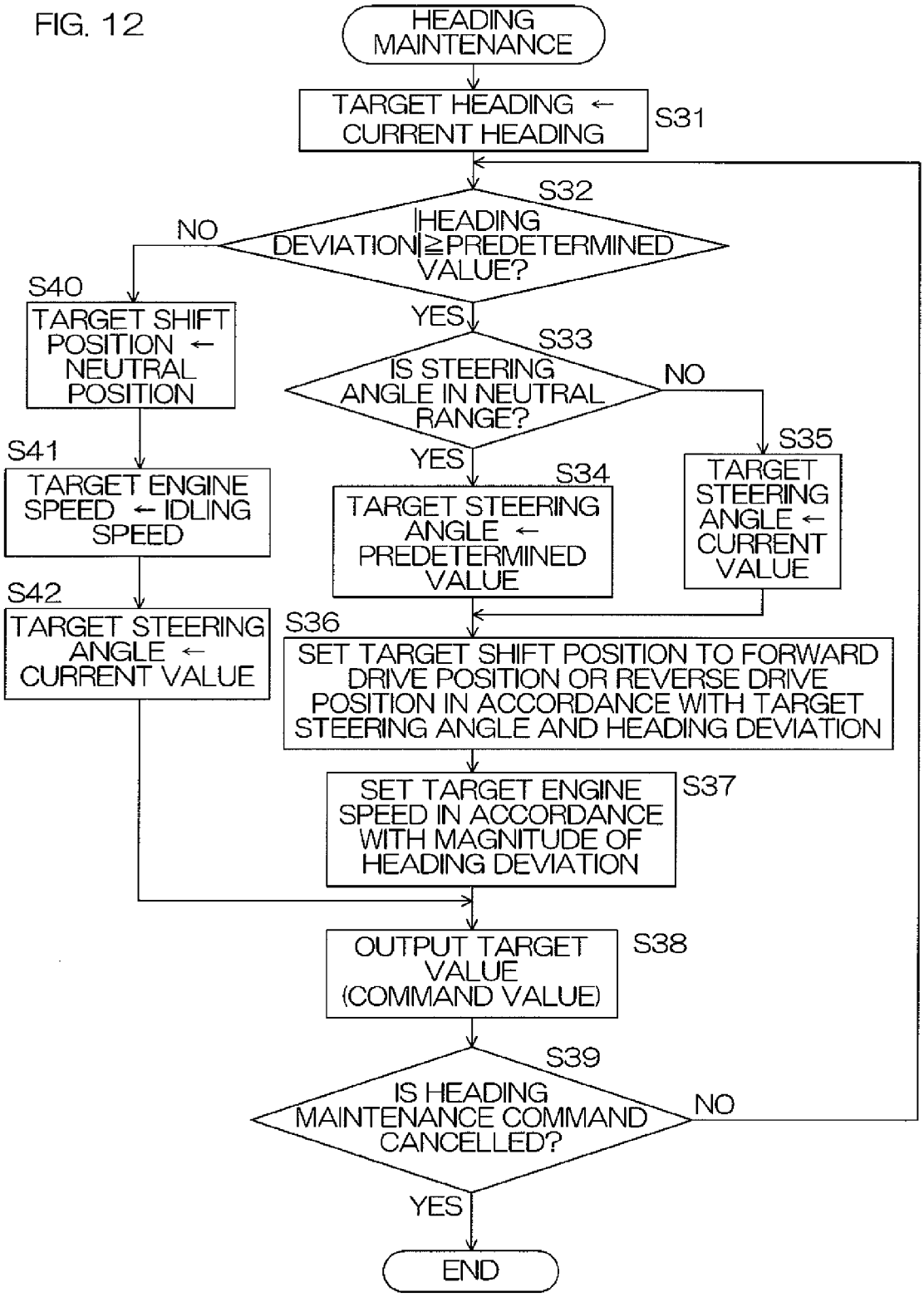
FIG. 12 is a flowchart for explaining contents of a process executed by the hull ECU in response to operation of a heading maintenance button in the third preferred embodiment of the present invention.

FIG. 12 is a flowchart for explaining contents of a process executed by the hull ECU 20 in response to operation of the heading maintenance button 80. When the heading maintenance button 80 is operated, the hull ECU 20 sets the heading being detected at that time by the heading sensor 18 as a target heading (step S31). For example, the hull ECU 20 may be programmed to use the target heading value at the point in time of setting as a reference value (for example, zero) and thereafter use the output of the heading sensor 18 as a relative heading value with respect to the reference value.

Further, the hull ECU 20 compares the heading detected by the heading sensor 18 (current heading of the hull 2) with the target heading (step S32). For example, the hull ECU 20 judges whether or not a magnitude of a deviation between the current heading value and the target heading value (heading deviation=current heading value−target heading value) is no less than a predetermined value.

If the magnitude of the heading deviation is no less than the predetermined value, the hull ECU 20 judges whether or not the steering angle of the steering unit 12 is a value within the neutral range (step S33). The neutral range may be a range that includes only the neutral value or may be a predetermined minute steering angle range that includes the neutral value. If the steering angle of the steering unit 12 is a value within the neutral range, the hull ECU 20 sets the target steering angle of the steering unit 12 to a predetermined value besides zero (step S34). The predetermined value may be set to a negative value if the heading of the hull 2 points to the right relative to the target heading and set to a positive value if the heading of the hull 2 points to the left relative to the target heading. If the steering angle is not a value within the neutral range (step S33: NO), the hull ECU 20 maintains the target steering angle at the current value (step S35). When the target steering angle is thus determined, the hull ECU 20 sets the target shift position of the outboard motor 11 based on the sign (direction) of the target steering angle and the sign of the heading deviation (direction) (step S36).

The sign of the heading deviation is, for example, positive when the current heading is a heading that is biased in the rightward turning (clockwise) direction relative to the target heading and negative when the current heading is a heading that is biased in the leftward turning (counterclockwise) direction relative to the target heading. Also, when the target steering angle is positive, the line of action 71 of the propulsive force of the outboard motor 11 passes through the left side of the rotation center. Thus, by setting the shift position of the outboard motor 11 to the forward drive position, a moment in the rightward turning direction can be applied to the hull 2, and by setting the shift position of the outboard motor 11 to the reverse drive position, a moment in the leftward turning direction can be applied to the hull 2. On the other hand, when the target steering angle is negative, the line of action 71 of the propulsive force of the outboard motor 11 passes through the right side of the rotation center. Thus, by setting the shift position of the outboard motor 11 to the forward drive position, a moment in the leftward turning direction can be applied to the hull 2, and by setting the shift position of the outboard motor 11 to the reverse drive position, a moment in the rightward turning direction can be applied to the hull 2.

Thus, when the sign of the heading deviation is positive, the target shift position is set to the reverse drive position if the target steering angle is positive, and the target shift position is set to the forward drive position if the target steering angle is negative. When the sign of the heading deviation is negative, the target shift position is set to the forward drive position if the target steering angle is positive, and the target shift position is set to the reverse drive position if the target steering angle is negative.

The hull ECU 20 further sets the target engine speed (target propulsive force) according to the magnitude (absolute value) of the heading deviation (step S37). That is, the engine speed is set higher the greater the heading deviation.

The target steering angle that is thus set is provided to the steering ECU 14 via the inboard LAN 25, and the target shift position and the target engine speed are provided to the outboard motor ECU 13 via the inboard LAN 25 (step S38).

The hull ECU 20 also judges whether or not the heading maintenance command by the heading maintenance button 80 is cancelled (step S39). If the heading maintenance command is not cancelled, the process from step S32 is repeated. If the heading maintenance command is cancelled, the heading maintenance control is ended. For example, the hull ECU 20 may be programmed to interpret a second operation input of the heading maintenance button 80 as a heading maintenance cancellation command. Also, the hull ECU 20 may be programmed to interpret an input from the joystick unit 10 during heading maintenance control as the heading maintenance cancellation command.

If in step S32, the magnitude of the heading deviation is less than the predetermined value, the target shift position is set to the neutral position (step S40), the target engine speed is set to the idling speed (step S41), and the target steering angle is maintained at the current value (step S42). Thereafter, the process from step S38 is performed.

Thus, with the present preferred embodiment, when the steering angle is not of a value within the neutral range, the heading of the hull 2 is maintained by control of the direction and magnitude of the propulsive force of the outboard motor 11 and without change of the target steering angle. Occasions of actuation and actuation time of the steering actuator 53 can thereby be lessened and a contribution can thus be made toward energy savings.

The judgment in step S33 may be made using the target steering angle at that time instead of using the steering angle of the steering unit 12.

Fourth Preferred Embodiment

Figure 13:
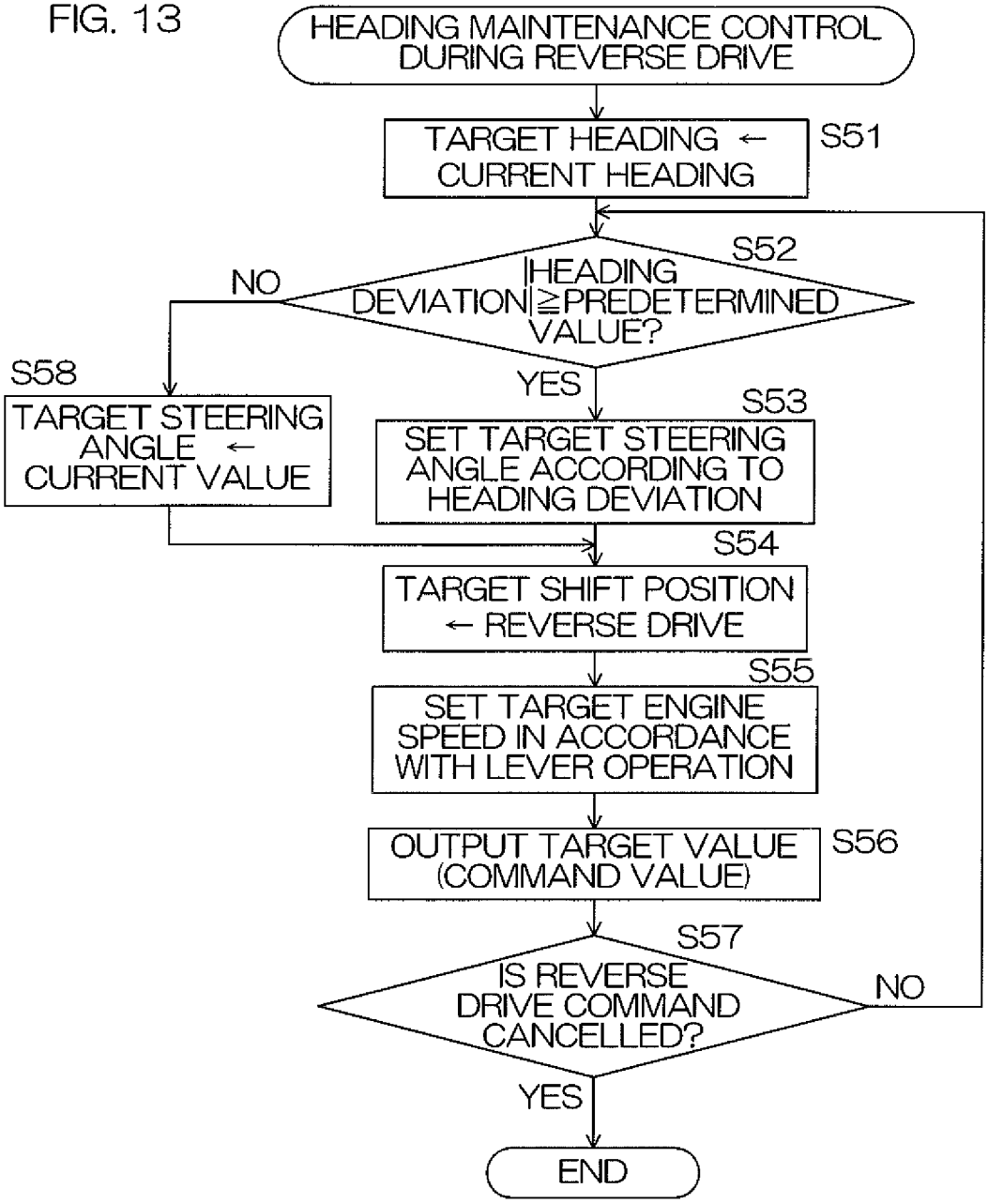
FIG. 13 is a flowchart of an example of a process executed by the hull ECU provided in a marine vessel according to a fourth preferred embodiment of the present invention.

FIG. 13 is a flowchart of an example of a process executed by the hull ECU 20 provided in a marine vessel according to a fourth preferred embodiment of the present invention. FIG. 11 shall be referenced again for explanation of the fourth preferred embodiment. However, the heading maintenance button 80 does not have to be provided necessarily in the fourth preferred embodiment.

In the fourth preferred embodiment, when reverse drive (moving toward the rear along the hull center line 5) of the hull 2 is commanded in the joystick maneuvering mode, the hull ECU 20 controls the steering unit 12 and the outboard motor 11 so as to maintain the heading of the hull 2. That is, when the reverse drive of the hull 2 is commanded, the hull ECU 20 sets the heading that the heading sensor 18 is detecting at that time as the target heading (step S51). Further, the hull ECU 20 compares the heading detected by the heading sensor 18 (current heading of the hull 2) and the target heading (step S52). For example, the hull ECU 20 judges whether or not the magnitude of the deviation between the current heading value and the target heading value (heading deviation=current heading value−target heading value) is no less than a predetermined value.

If the magnitude of the heading deviation is no less than the predetermined value, the hull ECU 20 sets the target steering angle so that a stem turning moment corresponding to the sign (direction) and magnitude of the heading deviation is provided to the hull 2 (step S53). The target shift position is set to the reverse drive position (step S54) because the reverse drive command is input. Thus, if the sign of the heading deviation is positive, the target steering angle is set to a positive value to provide a leftward stem turning moment to the hull 2. Oppositely, if the sign of the heading deviation is negative, the target steering angle is set to a negative value to provide a rightward stem turning moment to the hull 2. The magnitude (absolute value) of the target steering angle is set according to the magnitude of the heading deviation. The hull ECU 20 sets the target engine speed (target propulsive force) according to the tilt amount of the lever 7 to the rear (step S55).

The hull ECU 20 provides the set target steering angle to the steering ECU 14 via the inboard LAN 25 (step S56). Also, the target shift position (reverse drive position) and the target engine speed are provided to the outboard motor ECU 13 via the inboard LAN 25 (step S56).

The hull ECU 20 also monitors the output of the joystick unit 10 and judges whether or not the reverse drive command is cancelled (step S57). If the reverse drive command is not cancelled, the process from step S52 is repeated. If the reverse drive command is cancelled, the heading maintenance control is ended.

If in step S52, the magnitude of the heading deviation is less than the predetermined value, the target steering angle is maintained at the current value (step S58). Thereafter, the process from step S54 is performed.

By the present preferred embodiment, when the reverse drive command is provided by the joystick unit 10, the hull ECU 20 controls the steering angle to maintain the heading of the hull 2. The hull 2 can thereby be driven in reverse straightly.

By a gyro effect due to rotation of the propeller 40, the outboard motor 11 applies a lateral force, in a direction orthogonal to the propulsive force generated by the propeller 40, to the hull 2. The influence of the lateral force is manifested significantly during reverse drive of the hull 2 in particular. It is thus unexpectedly difficult to perform a marine vessel maneuvering of making the hull 2 retreat straightly. Specifically, even when the steering angle is set to zero, the hull 2 cannot be made to retreat straightly, and the steering angle must be set to a value other than zero to counter the lateral force. The heading maintenance control is thus performed during reverse drive of the hull 2 in the present preferred embodiment. Marine vessel maneuvering during reverse drive is thereby facilitated.

Fifth Preferred Embodiment

Figure 14:
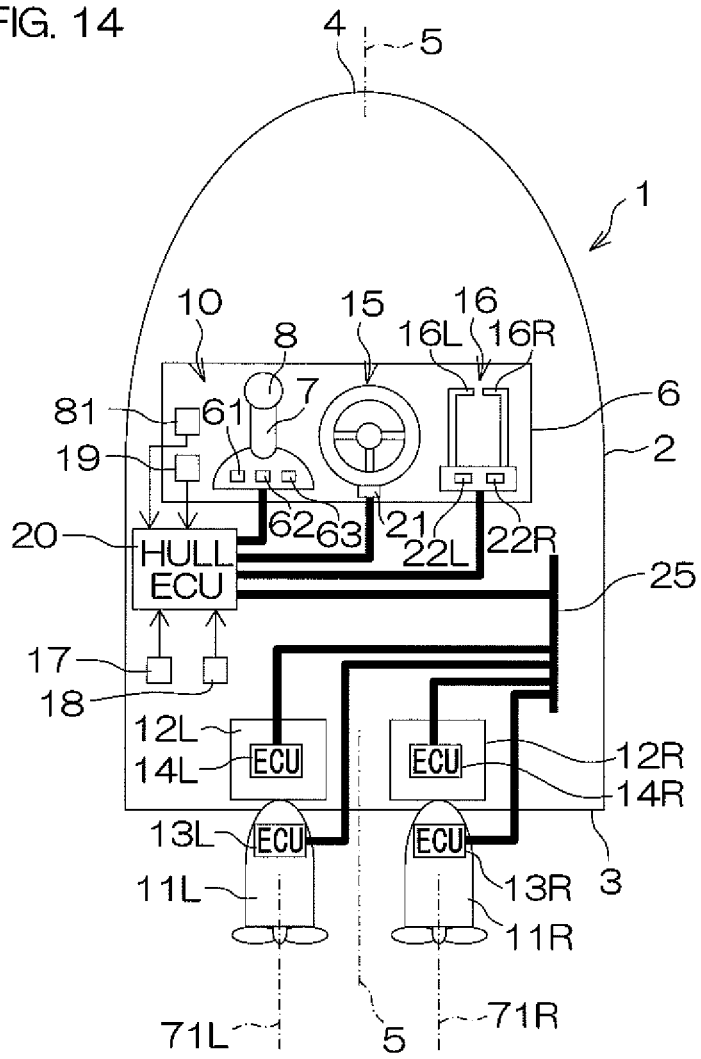
FIG. 14 is a schematic diagram for explaining an arrangement of a marine vessel according to a fifth preferred embodiment of the present invention.

FIG. 14 is a schematic diagram for explaining an arrangement of a marine vessel according to a fifth preferred embodiment of the present invention. In FIG. 14, portions equivalent to respective portions shown in FIG. 1 are indicated by the same reference symbols. With the fifth preferred embodiment, a fixed point maintenance button 81 (fixed point maintenance commanding unit), a position detector 17 (position detecting unit), and the heading sensor 18 (heading detecting unit) are included in addition to the arrangement of the first preferred embodiment. The heading maintenance button 81 is included in the operation console 6 and is arranged to be operated by the marine vessel operator when the position of the hull 2 is to be maintained at a fixed position. The position detector 17 generates a current position signal of the marine vessel 1 and can be arranged, for example, from a GPS (global positioning system) receiver that receives radio waves from GPS satellites to generate current position information. Outputs of the fixed point maintenance button 81, the position detector 17, and the heading sensor 18 are provided to the hull ECU 20.

Figure 15:
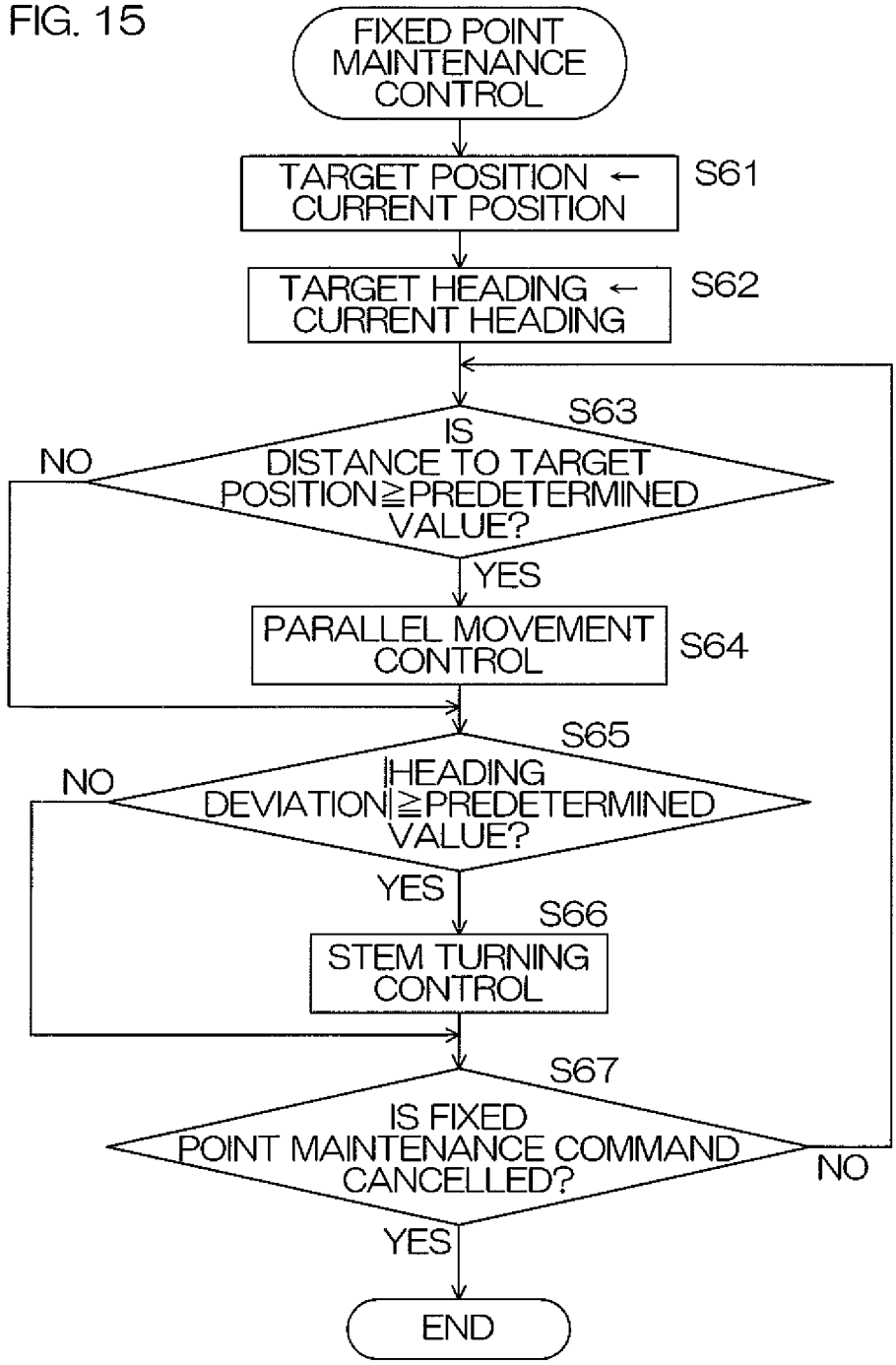
FIG. 15 is a flowchart for explaining contents of a control process executed by the hull ECU in response to operation of a fixed point maintenance button.

FIG. 15 is a flowchart for explaining contents of a control process executed by the hull ECU 20 in response to operation of the fixed point maintenance button 81. When the fixed point maintenance button 81 is operated, the hull ECU 20 sets the target position to the position being detected by the position detector 17 at that time (step S61) and sets the target heading to the heading being detected by the heading sensor 18 at that time (step S62).

Further, the hull ECU 20 compares the position detected by the position detector 17 and the target position (step S63). That is, the hull ECU 20 judges whether or not the distance between the current position and the target position is no less than a predetermined value. If the distance between the current position and the target position is no less than the predetermined value, the hull ECU 20 controls the steering units 12R and 12L and the outboard motors 11R and 11L so as to make the hull 2 undergo parallel movement toward the target position (step S64). The specific control contents in this case are the same as the control contents corresponding to the operation examples A7 and A8 of FIG. 4 of the first preferred embodiment. If the distance between the current position and the target position is less than the predetermined value, such positional correction control is omitted.

Further, the hull ECU 20 compares the heading detected by the heading sensor 18 (current heading of the hull 2) and the target heading (step S65). That is, the hull ECU 20 judges whether or not the magnitude of the deviation between the current heading value and the target heading value (heading deviation=current heading value−target heading value) is no less a predetermined value. If the magnitude of the heading deviation is no less than the predetermined value, the hull ECU 20 controls the steering units 12R and 12L and the outboard motors 11R and 11L so as to resolve the heading deviation (step S66). If the heading deviation is positive, the current heading of the hull 2 is deviated in a rightward turning direction relative to the target heading. The hull ECU 20 thus sets the target steering angles of the right and left steering units 12R and 12L and the target shift positions and the target engine speeds of the right and left outboard motors 11R and 11L so as to make the hull 2 undergo a leftward stem turn on the spot. If the heading deviation is negative, the current heading of the hull 2 is deviated in a leftward turning direction relative to the target heading. The hull ECU 20 thus sets the target steering angles of the right and left steering units 12R and 12L and the target shift positions and the target engine speeds of the right and left outboard motors 11R and 11L so as to make the hull 2 undergo a rightward stem turn on the spot. Details of such stem turning control are the same as the control contents corresponding to the operation example A5 of FIG. 4 of the first preferred embodiment. If the heading deviation is less than the predetermined value, the heading correction control is omitted.

Also, the hull ECU 20 judges whether or not the fixed point maintenance command by the fixed point maintenance button 81 is cancelled (step S67). For example, the hull ECU 20 may be programmed to interpret a second operation input of the fixed point maintenance button 81 as a fixed point maintenance cancellation command. Also, the hull ECU 20 may be programmed to interpret an input from the joystick unit 10 during fixed point maintenance control as the fixed point maintenance cancellation command. If the fixed point maintenance command is not cancelled, the process from step S63 is repeated. If the fixed point maintenance command is cancelled, the fixed point maintenance control is ended.

Thus, by the present preferred embodiment, the position of the marine vessel 1 can be maintained by operating the fixed point maintenance button 81. Thus, even under circumstances where, due to influences of current flow and wind, expertise is required for marine vessel maneuvering for maintaining the marine vessel 1 at a fixed position, this object can be accomplished readily by operating the fixed point maintenance button 81.

For example, the marine vessel operator operates the fixed point maintenance button 81 when fixing the position of the hull 2 at a fishing point is desired or when performing so-called kite fishing. In response to this operation, the hull ECU 20 executes the control for maintaining the position and heading of the hull 2. The marine vessel 1 is thereby maintained automatically at a fixed point at a fixed heading. Kite fishing is a fishing method with which a kite is flown from a marine vessel and a fishing line is dropped underwater from a kite line. In ordinary kite fishing, a parachute, called a sea anchor, is deployed underwater to prevent movement of the marine vessel. The fixed point maintenance function of the present preferred embodiment can be used in place of using such a sea anchor. The trouble of deploying and recovering the sea anchor can thereby be omitted.

An operation in accordance with the operation example A9 of FIG. 4 of the first preferred embodiment may be performed to maintain the position and heading of the hull 2. That is, parallel movement and stem turning of the hull 2 may be performed simultaneously by setting the target steering angle, the target shift position, and the target engine speed according to the distance to the target position and the heading deviation.

Sixth Preferred Embodiment

Figure 16:
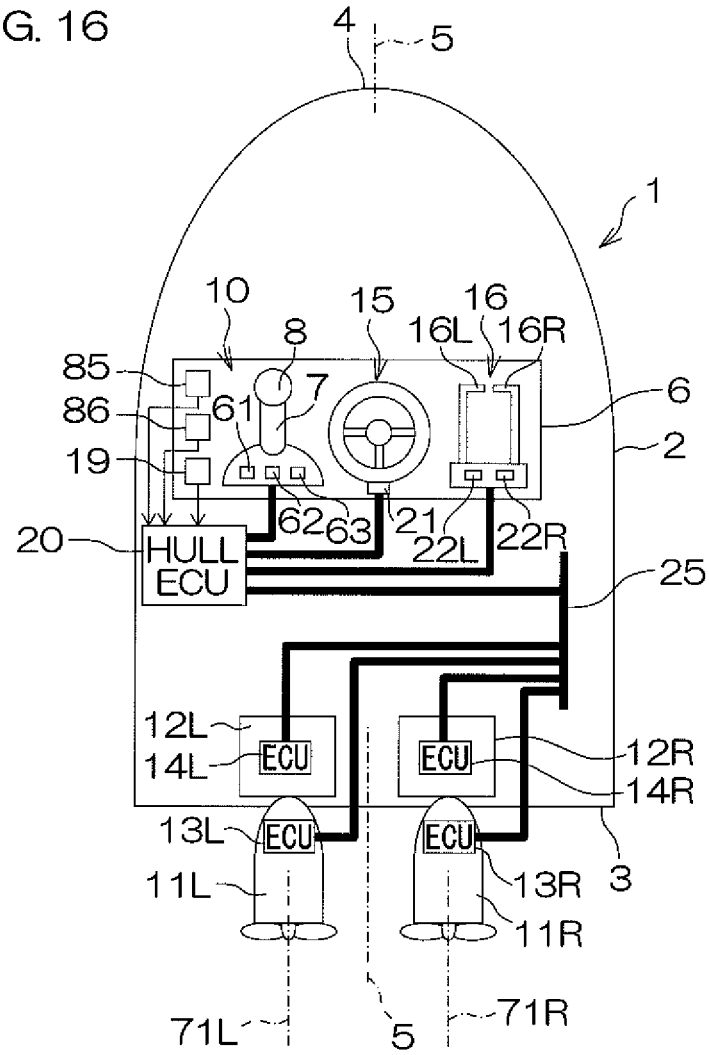
FIG. 16 is a schematic diagram for explaining an arrangement of a marine vessel according to a sixth preferred embodiment of the present invention.

FIG. 16 is a schematic diagram for explaining an arrangement of a marine vessel according to a sixth preferred embodiment of the present invention. In FIG. 16, portions equivalent to respective portions shown in FIG. 1 are indicated by the same reference symbols. The marine vessel according to the present preferred embodiment includes, in addition to the arrangement included in the first preferred embodiment, a lateral movement calibration button 85 and a stem turning calibration button 86 included as a calibration operation unit in the operation console 6. Signals from the buttons 85 and 86 are input into the hull ECU 20.

The lateral movement calibration button 85 is arranged to be operated by the operator to calibrate the propulsive forces of the outboard motors 11R and 11L and the steering angles of the steering units 12R and 12L in making the hull 2 undergo lateral movement (parallel movement) to the right or left in the joystick maneuvering mode. As described above, in making the hull 2 undergo parallel movement, the target steering angles of the right and left steering units 12R and 12L are set to achieve a state where the lines of action 71R and 71L of the outboard motors 11R and 11L both pass through the rotation center 70 (see operation example A7 of FIG. 4). If the propulsive forces generated by the right and left outboard motors 11R and 11L in this state are made equal (that is, if the engine speeds are made equal), the hull 2 should undergo parallel movement in a lateral direction orthogonal to the center line 5. However, in actuality, movement of the hull 2 to the front or the rear occurs due to a difference in the propulsive forces of the right and left outboard motors 11R and 11L, etc. The lateral movement calibration includes a propulsive force calibration and a steering angle calibration that are performed to lessen such movement of the hull 2 to the front or rear.

As described above, in making the hull 2 undergo lateral movement, the shift position of one of the right and left outboard motors 11R and 11L is controlled to be at the forward drive position, and the shift position of the other motor is controlled to be at the reverse drive position. Due to the structures of the outboard motors 11R and 11L and the hull 2, the propulsive force for driving the hull 2 forward (forward drive propulsive force) has a greater influence on the behavior of the hull 2 than the propulsive force to drive the hull 2 in reverse (reverse drive propulsive force). That is, the apparent propulsive force is greater when the shift position is at the forward drive position than when the shift position is at the reverse drive position. Thus, in the present preferred embodiment, the outboard motor that generates the reverse drive propulsive force during lateral movement to the right or left is controlled to be at substantially the maximum output. There is thus little leeway for propulsive force adjustment in regard to the propulsive force that generates the reverse drive output, and thus the propulsive force of the outboard motor that generates the forward drive propulsive force is calibrated in the lateral movement calibration.

Figure 17:
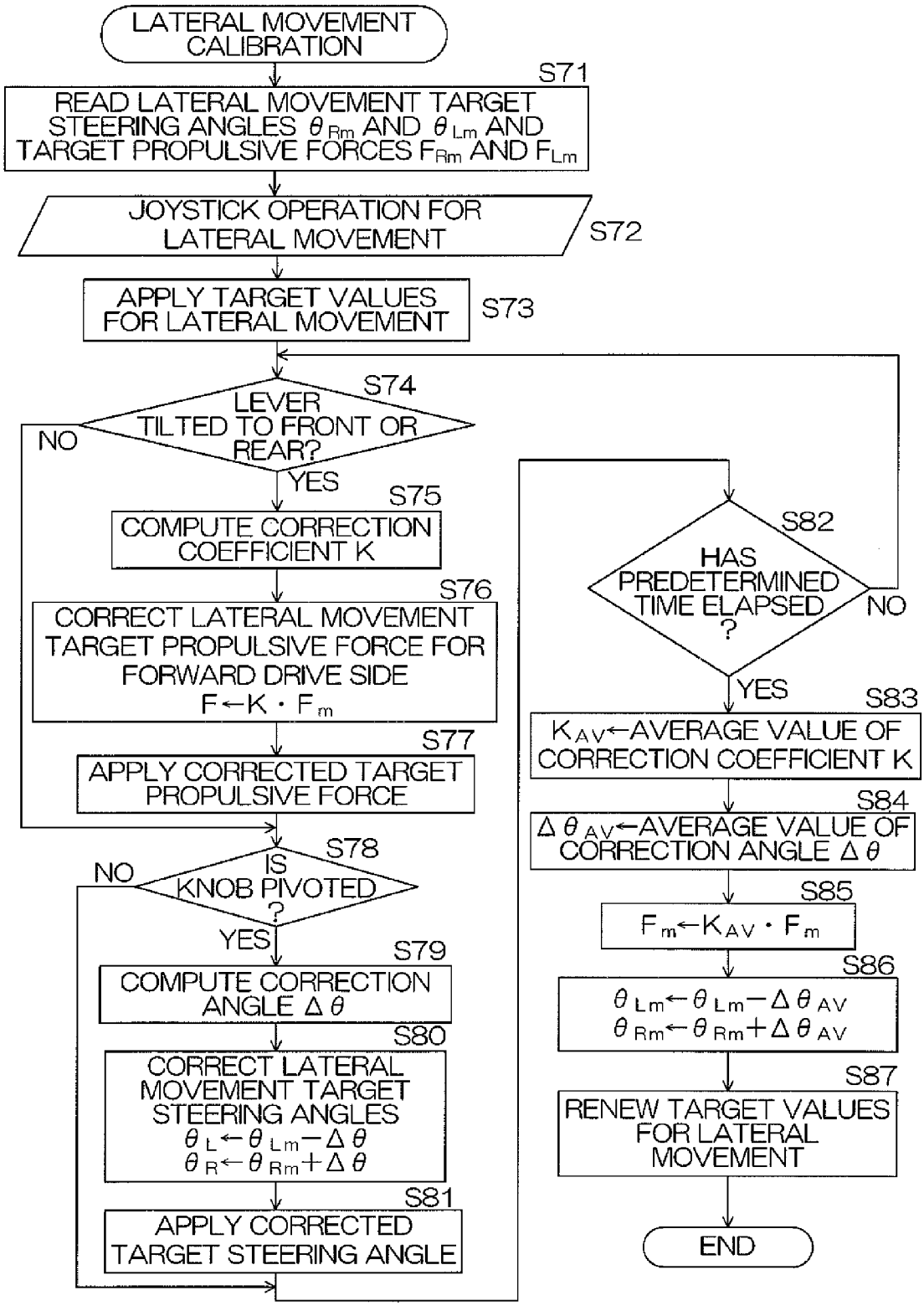
FIG. 17 is a flowchart for explaining a flow of a lateral movement calibration.

FIG. 17 is a flowchart for explaining a flow of the lateral movement calibration. When the lateral movement calibration button 85 is operated by the marine vessel operator, the hull ECU 20 starts the control for the lateral movement calibration. The hull ECU 20 references the memory 20M and reads the target steering angles and the target propulsive forces for lateral movement (step S71). More specifically, the hull ECU 20 reads lateral movement target steering angles $\theta_{Rm}$ and $\theta_{Lm}$ of the right and left steering units 12R and 12L and the lateral movement target propulsive forces $F_{Rm}$ and $F_{Lm}$ that are to be generated by the right and left outboard motors 11R and 11L. These target values are stored in the memory 20M in respective correspondence to left lateral movement and right lateral movement. That is, the target steering angles of the right and left steering units 12R and 12L and the target propulsive forces of the right and left outboard motors 11R and 11L are stored in the memory 20M in association with the joystick inputs for left lateral movement and right lateral movement. This is an example of a relationship characteristic of the outputs of the joystick unit and the target values.

The marine vessel operator tilts the lever 7 of the joystick unit 10 to make the hull 2 undergo lateral movement (step S72). Accordingly, the hull ECU 20 applies the target steering angles and the target propulsive forces for the right lateral movement or the left lateral movement in accordance with the tilt direction of the lever 7 (step S73). That is, the hull ECU 20 provides the corresponding target steering angles to the steering ECUs 14R and 14L of the right and left steering units 12R and 12L. Also, the hull ECU 20 computes the target shift positions and the target engine speeds corresponding to the target propulsive forces $F_{Rm}$ and $F_{Lm}$ of the right and left outboard motors 11R and 11L and provides these to the outboard motor ECUs 13R and 13L.

If the hull 2 moves in the front or rear direction, the marine vessel operator tilts the lever 7 to the front or rear to correct the front or rear direction movement. In accordance with the front or rear tilting operation of the lever 7 (step S74), the hull ECU 20 computes a correction coefficient K (step S75). Further, the hull ECU 20 multiplies the target propulsive force $F_m$ (=$F_{Rm}$ or $F_{Lm}$) of the outboard motor that is generating the propulsive force in the forward drive direction by the correction factor K to correct the target propulsive force F (step S76). The target shift position and the target engine speed corresponding to the corrected target propulsive force F (=K $F_m$) are provided from the hull ECU 20 to the outboard motor that is generating the propulsive force in the forward drive direction (step S77). The front or rear direction movement of the hull 2 is thereby corrected.

Also, if the hull 2 performs stem turning, the marine vessel operator operates the knob 8 to suppress the stem turning (step S78). The hull ECU 20 determines the correction angle $\Delta\theta$ in accordance with the turning operation of the knob 8 (step S79). Further, the hull ECU 20 corrects the lateral movement target steering angles $\theta_{Rm}$ and $\theta_{Lm}$ of the right and left steering units 12R and 12L by the correction angle $\Delta\theta$ to determine corrected target steering angles (step S80). For example, using the target steering angles $\theta_{Rm}$ and $\theta_{Lm}$ before correction, the corrected target steering angles $\theta_R$ and $\theta_L$ can be expressed as: $\theta_{Rm}+\Delta\theta$ and $\theta_{Lm}-\Delta\theta$. The corrected target steering angles $\theta_R$ and $\theta_L$ are provided from the hull ECU 20 to the right and left steering ECUs 14R and 14L (step S81). The target steering angles $\theta_R$ and $\theta_L$ are angles that are right/left symmetrical, and thus by the above correction, the lines of action 71R and 71L of the right and left outboard motors 11R and 11L are moved to the front or rear along the hull center line 5. The intersection of the lines of action 71R and 71L is thereby guided to the actual rotation center of the hull 2, and the stem turning of the hull 2 is thereby reduced.

Thereafter, the process of steps S74 to S81 is continued for a predetermined time (for example, 30 seconds) (step S82).

When the predetermined time elapses, the hull ECU 20 determines a time average value $K_{AV}$ of the correction coefficient K and a time average value $\Delta\theta_{AV}$ of the correction angle $\Delta\theta$ during the predetermined time (steps S83 and S84). Obviously, calculation of the time average values may be started at any suitable time during the process of steps S74 to S81. The hull ECU 20 multiplies the previous lateral movement target propulsive force $F_m$ of the outboard motor generating the propulsive force in the forward drive direction by the time average value $K_{AV}$ of the correction factor K by the hull ECU 20 to determine a new target propulsive force $F_m$ (=$K_{AV}$× previous $F_m$) (step S85). Likewise, the hull ECU 20 uses the time average value $\Delta\theta_{AV}$ of the correction angle $\Delta\theta$ to correct the previous lateral movement target steering angles $\theta_{Rm}$ and $\theta_{Lm}$ to determine new target steering angles $\theta_{Rm}$ (=previous $\theta_{Rm}+\Delta\theta_{AV}$) and $\theta_{Lm}$ (=previous $\theta_{Lm}-\Delta\theta_{AV}$) for lateral movement (step S86). The hull ECU 20 writes the new target propulsive force $F_m$ ($F_{Rm}$ or $F_{Lm}$) and the new target steering angles in the memory 20M (step S87). The relationship characteristic corresponding to the present lateral movement (left lateral movement or right lateral movement) is thereby renewed.

Figure 18:
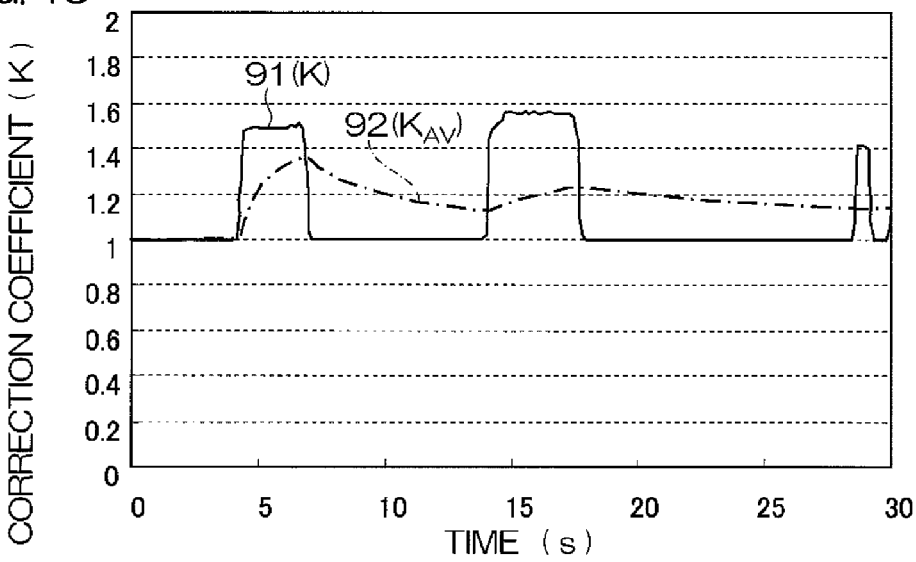
FIG. 18 shows an example of the lateral movement calibration.

FIG. 18 shows an example of the lateral movement calibration. A line 91 indicates a variation in time of the correction coefficient K corresponding to the front or rear direction tilting operation of the lever 7 of the joystick unit 10. A line 92 indicates a variation in time of the time average value $K_{AV}$ of the correction coefficient K. The time average value $K_{AV}$ of the correction coefficient K, for example, for 30 seconds from the point at which the calibration button 85 is operated is determined, and the lateral movement propulsive force of the outboard motor that generates the forward drive propulsive force is calibrated by the time average value $K_{AV}$.

Figure 19A:
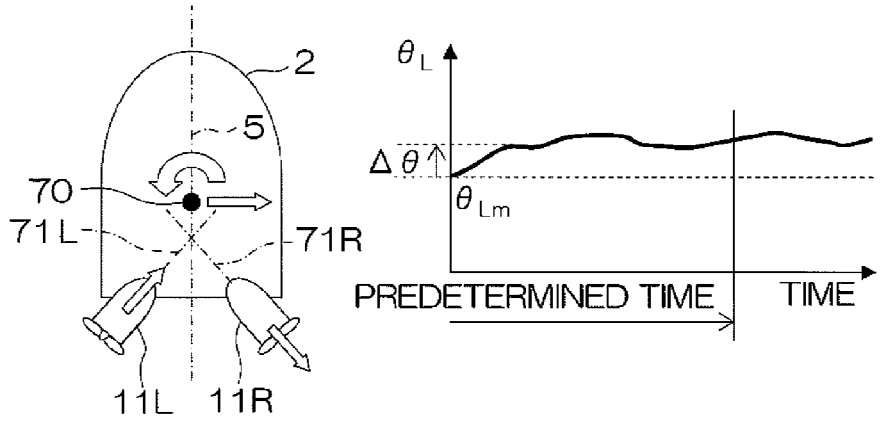
FIGS. 19A and 19B show variations in time of a correction angle in the lateral movement calibration.
Figure 19B:
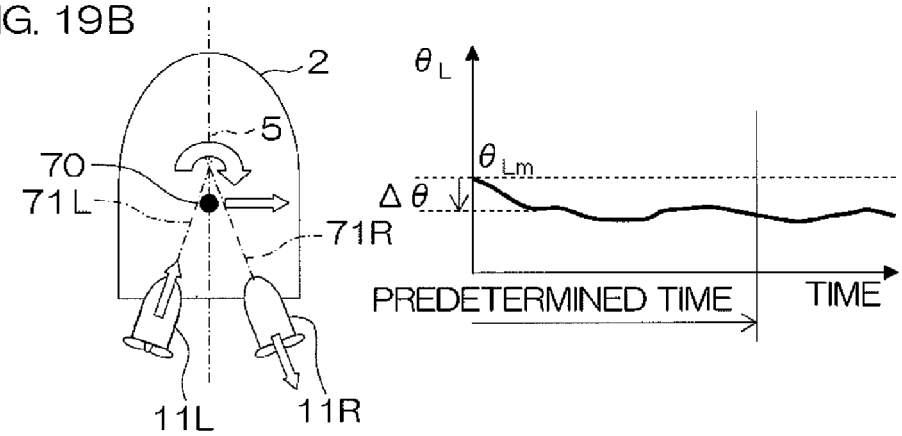

FIG. 19A and FIG. 19B show variations in time of the target steering angle $\theta_L$ of the left steering unit 12L in the lateral movement calibration. The correction angle $\Delta\theta$ is the deviation of the target steering angle $\theta_L$ with respect to the lateral movement target steering angle $\theta_{Lm}$ that is the initial value. FIG. 19A shows an example where the intersection of the lines of action 71R and 71L is moved to the rear relative to the rotation center 70, and FIG. 19B shows an example where the intersection of the lines of action 71R and 71L is moved to the front relative to the rotation center 70. The actual rotation center may vary according to cargo, number of occupants, etc., of the marine vessel 1 and the designed rotation center 70 and the actual rotation center are thus not necessarily matched. Influences of such mismatch can be eliminated by the lateral movement calibration.

The stem turning calibration button 86 is arranged to be operated by the marine vessel operator to calibrate the propulsive forces of the outboard motors 11R and 11L when making the hull 2 undergo rightward or leftward stem turning (on-the-spot stem turning) in the joystick maneuvering mode. When the hull 2 is made to undergo stem turning on the spot, the outboard motors 11R and 11L are controlled to V shape attitudes with which the lines of action 71R and 71L intersect at the rear of the outboard motors 11R and 11L as described above (operation example A5 of FIG. 4). In this case, if the absolute values of the steering angles of the right and left steering units 12R and 12L are made large, a large stem turning moment can be applied to the hull 2. If the propulsive forces generated by the right and left outboard motors 11R and 11L that are controlled to the V shape attitudes are made equal (that is, if the engine speeds are made equal), the hull 2 should undergo stem turning about the rotation center 70. However, in actuality, movement of the hull 2 to the front, rear, right, or left occurs due to the difference in the propulsive forces of the right and left outboard motors 11R and 11L, etc. The stem turning calibration is the propulsive force calibration for lessening such movement of the hull 2.

As described above, to make the hull 2 undergo stem turning on the spot, the shift position of one of the right and left outboard motors 11R and 11L is controlled to be at the forward drive position, and the shift position of the other is controlled to be at the reverse drive position. As mentioned above, the forward drive propulsive force has a greater influence on the hull behavior than the reverse drive propulsive force. Thus, in the present preferred embodiment, the outboard motor that generates the reverse drive propulsive force when the hull 2 is made to undergo stem turning on the spot is controlled to be substantially the maximum output. There is thus little leeway for propulsive force adjustment in regard to the outboard motor that generates the reverse drive output, and thus the propulsive force of the outboard motor that generates the forward drive propulsive force is calibrated in the stem turning calibration.

Figure 20:
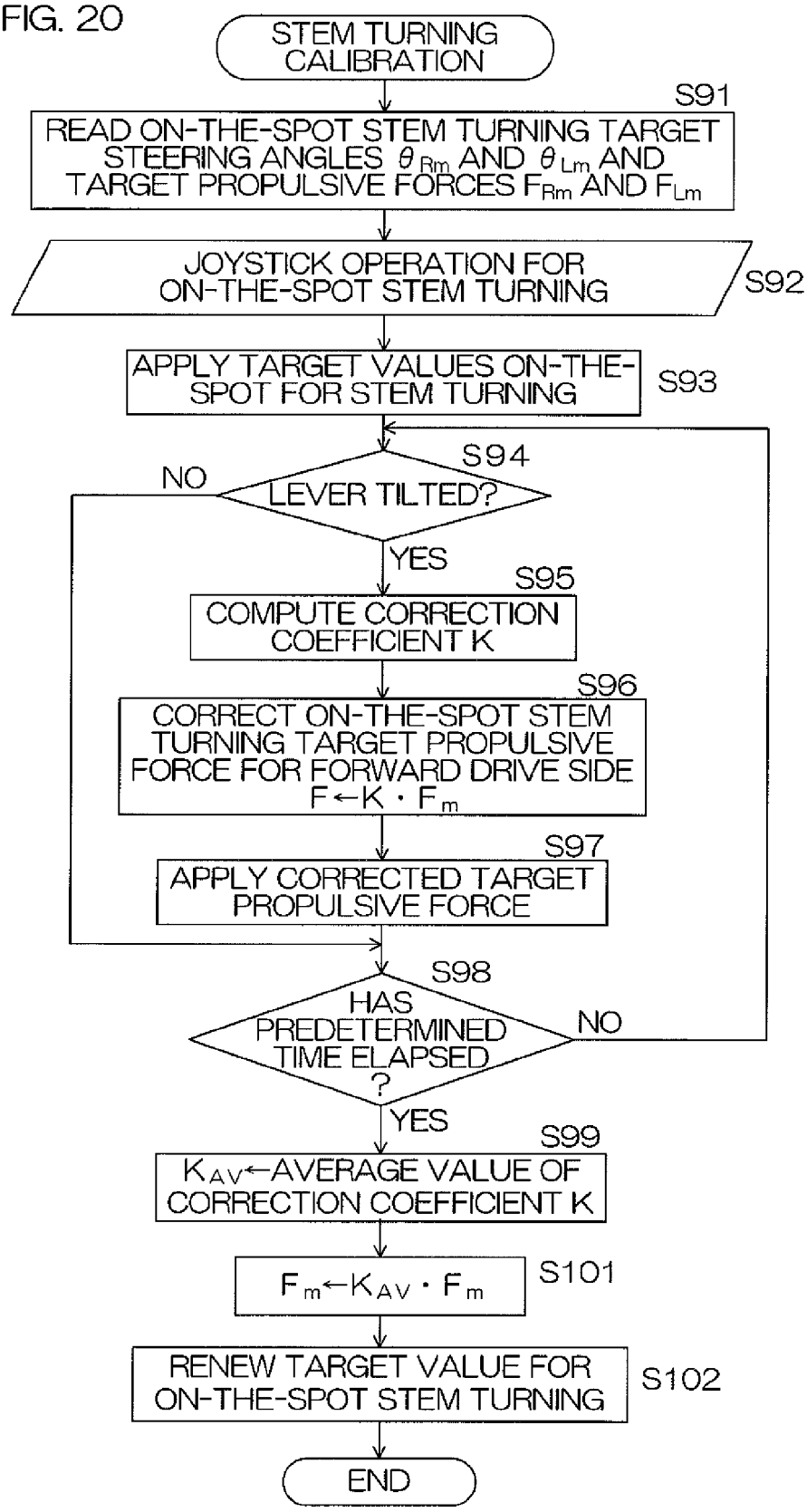
FIG. 20 is a flowchart for explaining a flow of a stem turning calibration.

FIG. 20 is a flowchart for explaining a flow of the stem turning calibration. When the stem turning calibration button 86 is operated by the marine vessel operator, the hull ECU 20 starts the control for the stem turning calibration. The hull ECU 20 references the memory 20M and reads the target steering angles $\theta_{Rm}$ and $\theta_{Lm}$ and the target propulsive forces $F_{Rm}$ and $F_{Lm}$ for on-the-spot stem turning (step S91). These target values generally differ from the target values for lateral movement. The target values are stored in the memory 20M in respective correspondence to leftward stem turning and rightward stem turning. That is, the target steering angles of the right and left steering units 12R and 12L and the target propulsive forces of the right and left outboard motors 11R and 11L are stored in the memory 20M in association with the joystick inputs for leftward stem turning and rightward stem turning. This is an example of a relationship characteristic of the outputs of the joystick unit and the target values.

The marine vessel operator pivots the knob 8 of the joystick unit 10 rightward or leftward from the neutral position to make the hull 2 undergo on-the-spot stem turning (step S92). Accordingly, the hull ECU 20 applies the target steering angles and the target propulsive forces for the rightward or leftward stem turning in accordance with the turning operation direction of the knob 8 (step S93). That is, the hull ECU 20 provides the corresponding target steering angles to the steering ECUs 14R and 14L of the right and left steering units 12R and 12L. Also, the hull ECU 20 computes the target shift positions and the target engine speeds corresponding to the target propulsive forces $F_R$ and $F_L$ of the right and left outboard motors 11R and 11L and provides these to the outboard motor ECUs 13R and 13L.

If the hull 2 moves in the front or rear direction or the right or left direction, the marine vessel operator tilts the lever 7 to the front, rear, right, or left to correct the movement (step S94). In accordance with the tilting operation of the lever 7, the hull ECU 20 computes a correction coefficient K (step S95). Further, the hull ECU 20 multiplies the target propulsive force $F_m$ (=$F_{Rm}$ or $F_{Lm}$) by the correction factor K to correct the target propulsive force $F_m$ (step S96). The target shift position and the target engine speed corresponding to the corrected target propulsive force F (=K $F_m$) are provided from the hull ECU 20 to the outboard motor that is generating the propulsive force in the forward drive direction (step S97). The movement of the hull 2 is thereby corrected.

Thereafter, the process of steps S94 to S97 is continued for a predetermined time (for example, 180 seconds) (step S98).

When the predetermined time elapses, the hull ECU 20 determines a time average value $K_{AV}$ of the correction coefficient K during the predetermined time (step S99). The calculation of the time average value $K_{AV}$ may be started at any suitable time during the process of steps S94 to S97. The hull ECU 20 multiplies the previous on-the-spot stem turning target propulsive force $F_m$ of the outboard motor generating the propulsive force in the forward drive direction by the time average value $K_{AV}$ to determine a new target propulsive force $F_m$ (=$K_{AV}$×previous $F_m$) (step S101). The hull ECU 20 writes the new target propulsive force $F_m$ in the memory 20M (step S102). The relationship characteristic corresponding to the present stem turning (leftward stem turning or rightward stem turning) is thereby renewed.

Figure 21:
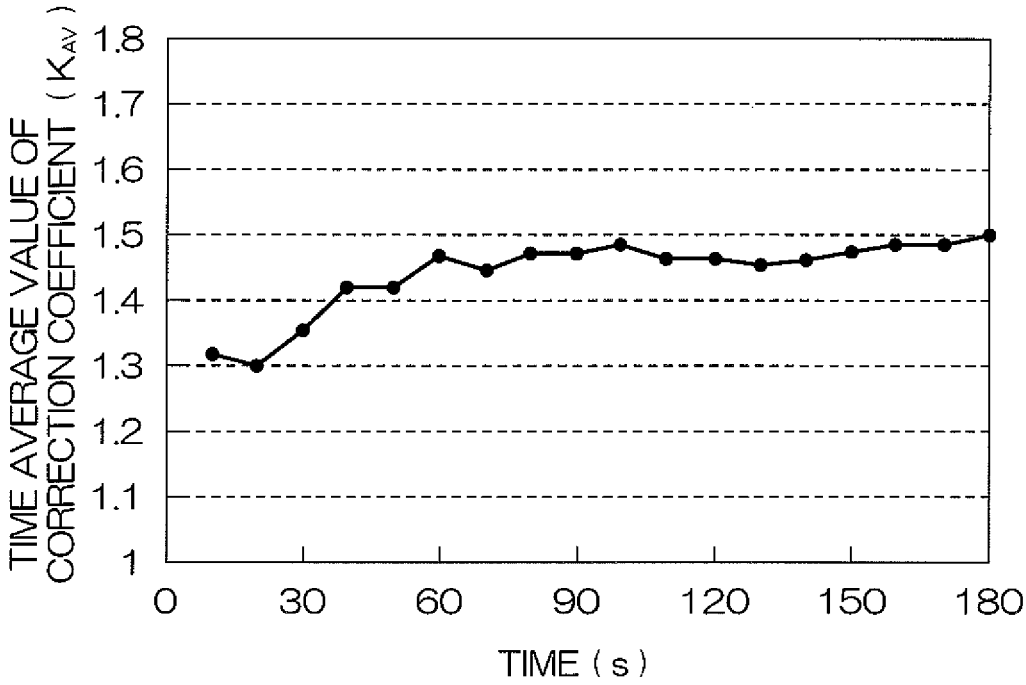
FIG. 21 shows an example of the stem turning calibration.

FIG. 21 shows an example of the stem turning calibration. Specifically, a variation in time of the time average value $K_{AV}$ of the correction coefficient K that changes in response to the tilting operation in the front, rear, right, and left directions of the lever 7 of the joystick unit 10 is shown. The time average value $K_{AV}$ of the correction coefficient K, for example, for 180 seconds from the point at which the stem turning calibration button 86 is operated is determined, and the stem turning propulsive force target value of the outboard motor that generates the forward drive propulsive force is calibrated using the time average value $K_{AV}$.

Figure 22A:
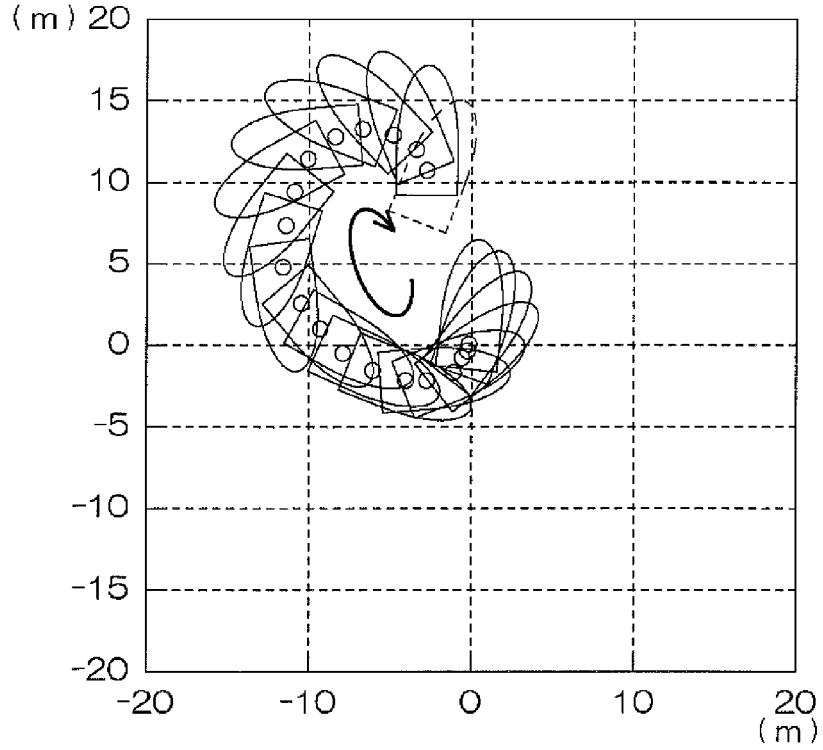
FIGS. 22A and 22B show marine vessel track examples of the hull when a rightward stem turning operation is actually performed.
Figure 22B:
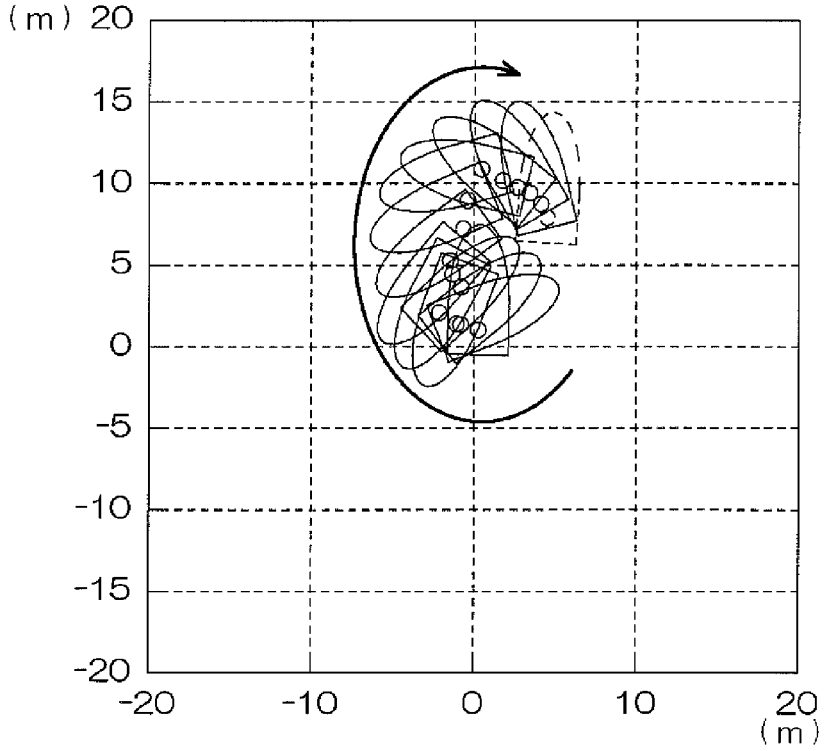

FIG. 22A and FIG. 22B show marine vessel track examples of the hull 2 when rearward rightward stem turning operations are actually performed. The rearward rightward stem turning refers to performing stem turning substantially on the spot by minimizing positional variation of the hull 2 while making the hull 2 move rearward. FIG. 22A shows the marine vessel track before the stem turning calibration, and the FIG. 22B shows the marine vessel track after execution of the stem turning calibration. It can be understood that the turning radius is reduced significantly by the stem turning calibration.

Although in the present preferred embodiment, the average values of the correction coefficients, etc., within predetermined times from the points of operation of the calibration buttons 85 and 86, are preferably determined and the target propulsive force and the target steering angles are preferably calibrated by the average values, another calibration method may be applied instead. For example, after the lateral movement calibration is started in response to the operation of the lateral movement calibration button 85, the lateral movement calibration button 85 may be operated again and the target propulsive force and the target steering angles may be calibrated using the correction coefficients, etc., that are applied at the timing at which the button 85 is operated again. In this case, the marine vessel operator performs the second operation of the lateral movement calibration button 85 when the hull 2 is undergoing lateral movement as intended. Also, when the lateral movement calibration button 85 is operated the second time, the target propulsive force and the target steering angles may be calibrated using the average values of the correction coefficients, etc., during an immediately previous predetermined time (for example, 30 seconds). Likewise in the stem turning calibration, after the stem turning calibration is started in response to the operation of the stem turning calibration button 86, the stem turning calibration button 86 may be operated again and the target propulsive force may be calibrated using the correction coefficient that is applied at the timing at which the button 86 is operated again. In this case, the marine vessel operator performs the second operation of the stem turning calibration button 86 when the hull 2 is undergoing stem turning as intended. Also, when the lateral movement calibration button 86 is operated the second time, the target propulsive force may be calibrated using the average value of the correction coefficient during an immediately previous predetermined time (for example, 30 seconds). Further, the target propulsive force may be calibrated using the average value of the correction coefficient from the point at which the stem turning calibration button 86 is operated to the point at which the hull 2 rotates by a predetermined number of times (for example, by two turns).

Other Preferred Embodiments

The present invention can be put into practice in various embodiments besides the preferred embodiments described above. For example, although with the preferred embodiments, cases of application to two-motor-mounted outboard motor crafts and three-motor-mounted outboard motor crafts have been described, the present invention may also be applied to marine vessels having three or more outboard motors. For example, in a case of applying the first preferred embodiment to a three-motor-mounted outboard motor craft, the steering angle may be set to the neutral value and the shift position may be set to the neutral position in regard to the central outboard motor in the joystick maneuvering mode. In regard to the right and left outboard motors and the corresponding steering units, the same control as that of the first preferred embodiment may be executed.

Also, although with the preferred embodiments described above, outboard motors are used as examples of propulsion units, the present invention can likewise be applied to marine vessels that use other forms of propulsion units, such as an inboard/outboard motor, an inboard motor, etc.

Further, although with the preferred embodiments, marine vessels including the steering wheel 15 and the remote control lever unit 16 in addition to the joystick unit 10 have been described as examples, the present invention can also be applied to marine vessels having just the joystick unit 10.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2010-2177 filed in the Japan Patent Office on Jan. 7, 2010, and the entire disclosure of Japanese Patent Application No. 2010-2177 is hereby incorporated herein by reference.

What is claimed is:

1. A marine vessel propulsion control apparatus arranged to control a propulsion unit and a steering unit that steers the propulsion unit to the right and to the left, the marine vessel propulsion control apparatus comprising:

a joystick unit including a lever that is tiltable from a neutral position, the joystick unit being arranged to be operated by a marine vessel operator to command a heading direction and stem turning of a hull; and a control unit programmed to control an output of the propulsion unit and a steering angle of the steering unit in accordance with an output signal of the joystick unit, the control unit being programmed to, when the output of the propulsion unit is stopped by the lever being returned to the neutral position, maintain the steering angle of the steering unit at the steering angle of the steering unit before the output of the propulsion unit was stopped.

2. The marine vessel propulsion control apparatus according to claim 1, wherein the marine vessel propulsion control apparatus is arranged to control a right propulsion unit and a left propulsion unit, respectively disposed at a right and left of the hull, and a right steering unit and a left steering unit, respectively corresponding to the right propulsion unit and the left propulsion unit;

the control unit is programmed to control the steering angles of the right and left steering units so that lines of action of the propulsive forces generated by the right and left propulsion units define a V shape or an inverted V shape; and the control unit is programmed to maintain a state where the lines of action define the V shape or inverted V shape by maintaining the steering angles of the right and left steering units when the outputs of the right and left propulsion units are stopped.

3. The marine vessel propulsion control apparatus according to claim 1, wherein the marine vessel propulsion control apparatus is arranged to control a right propulsion unit and a left propulsion unit, respectively disposed at a right and left of the hull, and a right steering unit and a left steering unit, respectively corresponding to the right propulsion unit and the left propulsion unit;

the lever is arranged to be tiltable to the front, rear, right, and left of the neutral position;

the control unit is programmed to control the steering angles of the right and left steering units so that lines of action of the propulsive forces generated by the right and left propulsion units define a V shape or an inverted V shape; and the control unit is programmed to maintain a state where the lines of action of the right and left steering unit define the V shape or inverted V shape by maintaining the steering angles of the right and left steering units when a right/left direction tilt amount of the lever becomes no more than a predetermined value.

4. The marine vessel propulsion control apparatus according to claim 1, wherein the joystick unit further includes a pivoting operation section arranged to be pivotable from a neutral position; and the control unit is programmed to control the output of the propulsion unit and the steering angle of the steering unit to apply a stem turning moment to the hull in accordance with operation of the pivoting operation section.

5. The marine vessel propulsion control apparatus according to claim 4, wherein the control unit is programmed to control the output of the propulsion unit in accordance with front/rear direction tilting of the lever, and control the steering angle of the steering unit in accordance with operation of the pivoting operation section; and the control unit is programmed to stop the output of the propulsion unit and maintain the steering angle of the steering unit when the lever and the pivoting operation section are returned to the respective neutral positions.

6. The marine vessel propulsion control apparatus according to claim 5, wherein the control unit is programmed to control the steering angle of the steering unit to be within a steering angle range among a neutral range that includes a neutral value, a first range at one side of the neutral range, and a second range at the other side of the neutral range; and the control unit is further programmed to control the steering angle of the steering unit in accordance with the operation of the pivoting operation section without changing the steering angle range when the pivoting operation section is pivoted from its neutral position in the state where the lever is at its neutral position.

7. The marine vessel propulsion control apparatus according to claim 5, wherein the propulsion unit is arranged to be capable of switching the direction of the propulsive force between a first direction and a second direction that are directly opposite to each other; and the control unit is programmed to control the direction of the propulsive force of the propulsion unit to be the first direction or the second direction in accordance with the operation of the pivoting operation section if, when the pivoting operation section is operated with the lever being at the neutral position, the steering angle of the steering unit is not within the neutral range that includes the neutral value.

8. The marine vessel propulsion control apparatus according to claim 1, further comprising:

a mode switching unit arranged to switch a control mode of the control unit between an ordinary maneuvering mode and a joystick maneuvering mode; wherein the control unit is programmed to control the output of the propulsion unit according to operation of a remote control lever provided in a marine vessel and control the steering angle of the steering unit according to operation of a steering operation member provided, in the marine vessel in the ordinary maneuvering mode; and the control unit is programmed to control the output of the propulsion unit and the steering angle of the steering unit according to operation of the joystick unit and maintain the steering angle of the steering unit when the output of the propulsion unit is stopped, in the joystick maneuvering mode.

9. The marine vessel propulsion control apparatus according to claim 1, further comprising:

a calibration operation unit arranged to be operated by the marine vessel operator to set a propulsive force and a steering angle corresponding to a predetermined hull behavior; wherein the control unit is programmed to renew a relationship characteristic of the joystick unit output signal and the propulsive force and the steering angle in response to the operation of the calibration operation unit so that the predetermined hull behavior and the propulsive force and the steering angle correspond with each other.

10. A marine vessel comprising:

a hull;

a propulsion unit and a steering unit provided in the hull; and a marine vessel propulsion control apparatus according to claim 1 that is arranged to control the propulsion unit and the steering unit.

* * * * *